US012114720B2

(12) United States Patent
Berger et al.

(10) Patent No.: US 12,114,720 B2
(45) Date of Patent: Oct. 15, 2024

(54) METHOD FOR PREPARING REMOVABLY ATTACHABLE DECORATIVE ARTICLES

(71) Applicants: Dixie Sandra Berger, Saratoga, WY (US); Kirby Alan Berger, Saratoga, WY (US)

(72) Inventors: Dixie Sandra Berger, Saratoga, WY (US); Kirby Alan Berger, Saratoga, WY (US)

( * ) Notice: Subject to any disclaimer, the term of this patent is extended or adjusted under 35 U.S.C. 154(b) by 186 days.

(21) Appl. No.: 17/683,497

(22) Filed: Mar. 1, 2022

(65) Prior Publication Data

US 2022/0279886 A1 Sep. 8, 2022

Related U.S. Application Data

(60) Provisional application No. 63/155,458, filed on Mar. 2, 2021.

(51) Int. Cl.

| | |
|---|---|
| ***A42B 1/004*** | (2021.01) |
| ***A42C 1/08*** | (2006.01) |
| ***A45C 3/06*** | (2006.01) |
| ***A45C 13/08*** | (2006.01) |
| ***A45C 13/10*** | (2006.01) |

(52) U.S. Cl.

CPC ..... *A42B 1/004* (2013.01); *A42C 1/08* (2013.01); *A45C 3/06* (2013.01); *A45C 13/08* (2013.01); *A45C 13/1092* (2013.01)

(58) Field of Classification Search

CPC ..... A42B 1/004; A42B 1/248; A42C 1/08; A45C 3/06; A45C 13/08; A45C 13/1092

See application file for complete search history.

(56) References Cited

U.S. PATENT DOCUMENTS 5,581,815 A * 12/1996 Hans ..... A41D 13/0015 2/244

* cited by examiner

*Primary Examiner* — Rick K Chang

(74) *Attorney, Agent, or Firm* — Leber IP LAW; Celia H. Leber

(57) ABSTRACT

Methods for preparing a host article and a decorative patch for removable attachment to one another using snap fasteners. In one example, a method includes simultaneously punching a first plurality of holes arranged in a first pattern into a front surface of the hostarticle, positioning a plurality of host snap fasteners in the first plurality of holes, and simultaneously setting the plurality of host snap fasteners to secure the plurality of host snap fasteners to the host article. The method further includes simultaneously punching a second plurality of holes in a corresponding second pattern into a decorative patch and setting a plurality of patch snap fasteners in the second plurality of holes to secure the plurality of patch snap fasteners to the decorative patch, the plurality of patch snap fasteners being configured to mate with the plurality of host snap fasteners to removably attach the decorative patch to the host article.

9 Claims, 19 Drawing Sheets

METHOD FOR PREPARING REMOVABLY ATTACHABLE DECORATIVE ARTICLES

CROSS-REFERENCE TO RELATED APPLICATIONS

This application claims the benefits under 35 U.S.C. § 119(e) of U.S. Provisional Application No. 63/155,458 filed on Mar. 2, 2021 and titled "METHODS AND APPARATUS FOR PREPARING REMOVABLY ATTACHABLE DECORATIVE ARTICLES," which is herein incorporated by reference in its entirety for all purposes.

BACKGROUND

Systems and methods for decorating articles of clothing and accessories, such as bags, backpacks, etc., are well known. When items such as decorative patches or badges, for example, are conventionally attached to articles of clothing or accessories, they are typically attached by sewing them directly onto the item, using iron-on methods, or using adhesives, such as fabric glue. One of the problems associated with conventional systems and methods for decorating articles of clothing and accessories is limited use. For example, once the decoration is attached to the article of clothing or accessory using the methods noted above, it can be difficult to remove decoration, and the removal process can damage both the decoration and the clothing or accessory.

SUMMARY

Aspects and embodiments are directed to methods and apparatus for producing decorative patches and host articles (such as clothing or accessories) that can be interchangeably used and reused with one another without damaging either the decorative patch or the host article and overcoming the disadvantages of conventional approaches discussed above.

In one embodiment, a method of customizing a host article with a removably attachable decorative patch comprises simultaneously punching a first plurality of holes into a front surface of the host article, the first plurality of holes being arranged in a first regular pattern, positioning a plurality of host snap fasteners in the first plurality of holes, each host snap fastener corresponding to a respective one of the first plurality of holes, and simultaneously setting the plurality of host snap fasteners to secure the plurality of host snap fasteners to the host article. The method may further comprise simultaneously punching a second plurality of holes into a decorative patch, the second plurality of holes having a same number as the first plurality of holes and being arranged in a second regular pattern corresponding to the first regular pattern, and setting a plurality of patch snap fasteners in the second plurality of holes to secure the plurality of patch snap fasteners to the decorative patch, the plurality of patch snap fasteners being configured to mate with the plurality of host snap fasteners removably attach the decorative patch to the host article.

In one example, setting the plurality of patch snap fasteners includes positioning the plurality of patch snap fasteners in the second plurality of holes, each patch snap fastener corresponding to a respective one of the second plurality of holes, and simultaneously setting the plurality of host snap fasteners to secure the plurality of patch snap fasteners to the decorative patch.

In one example, the decorative patch has a rectangular shape, and the plurality of patch snap fasteners includes four patch snap fasteners, and wherein simultaneously punching the second plurality of holes into the decorative patch includes simultaneously punching four holes at the corners of the decorative patch, such that the second regular pattern is a rectangular pattern having a first horizontal hole spacing and a first vertical hole spacing. In one example, simultaneously punching the first plurality of holes into the host article includes simultaneously punching four holes, the first regular pattern being a rectangular pattern having a second horizontal hole spacing and a second vertical hole spacing. The first and second horizontal hole spacings may be the same of different. In certain examples, the second horizontal hole spacing is different from the first horizontal spacing by an amount that is determined by a curvature of the front surface of the host article.

In one example, simultaneously punching the first plurality of holes into the host article is performed using first and second hole punching plate assemblies attached to a press tool. In another example, simultaneously setting the plurality of host snap fasteners is performed using first and second snap setting plate assemblies attached to the press tool.

In another example, the method may further comprise simultaneously punching a third plurality of holes into a front surface of another host article, the third plurality of holes including four holes arranged in a third regular pattern, positioning a second plurality of host snap fasteners in the third plurality of holes, each host snap fastener corresponding to a respective one of the third plurality of holes, and simultaneously setting the second plurality of host snap fasteners to secure the second plurality of host snap fasteners to the additional host article. The third regular pattern may be a third rectangular pattern having a third horizontal hole spacing and a third vertical hole spacing. In certain examples, the first and third horizontal hole spacings are different and the first and third vertical hole spacings are different.

The host article may be a hat or a bag, for example.

According to another embodiment, a hole punching apparatus for preparing decorative articles with snap fasteners comprises a first hole punching plate assembly including a plate, a plurality of hole punchers attached to the plate, and an alignment spacer attached to the plurality of hole punchers and spaced apart from the plate, the plurality of hole punchers being arranged in a regular pattern on a first side of the plate and extending beyond the alignment spacer, and a second hole punching plate assembly including a base plate and a plurality of receiving pads mounted on the base plate and arranged in the regular pattern on a first side of the base plate, a number of the plurality of receiving pads corresponding to a number of the plurality of hole punchers, the second hole punching plate assembly further including a spacer positioned around the plurality of receiving pads on the first side of the base plate.

In one example, the plate is a rectangular plate, the number of the plurality of hole punchers is four, and wherein the regular pattern is a rectangular pattern with each hole puncher positioned proximate a corner of the rectangular plate. In another example, the base plate is a rectangular base plate, and the plurality of receiving pads are positioned proximate corners of the rectangular base plate. The plate and the base plate may be made of metal, for example. In one example, each of the plurality of receiving pads is a circular brass disk.

In one example, the hole punching apparatus may further comprise a press tool configured to receive the first and second hole punching plate assemblies, the press tool having a movable portion and a base positioned below the movable portion, wherein the first hole punching plate assembly is configured to be attached to the movable portion. The second hole punching plate assembly may be configured to be attached to the base, such that the first and second hole punching plate assemblies are aligned with one another, each of the plurality of hole punchers being centered and aligned with respect to corresponding ones of the plurality of receiving pads, and the press tool may be configured to be operable to lower the first hole punching plate assembly such that the plurality of hole punchers contact the plurality of receiving pads with sufficient force to punch holes into an article placed between the first and second hole punching plate assemblies.

In one example, the first hole punching plate assembly includes a mounting rod extending from a second side of the plate, the second side opposing the first side, the mounting rod being configured for attachment of the first hole punching plate assembly to the movable portion of the press tool.

In another example, the second hole punching plate assembly includes a mounting pin extending from a second side of the base plate, the second side opposing the first side, the mounting pin being configured for attachment of the second hole punching plate assembly to the base of the press tool. The base plate may include a flange having a hole therein for attachment of the second hole punching plate assembly to the base of the press tool.

In one example, the spacer of the second hole punching plate assembly has a lower surface contacting the base plate and an opposing substantially flat upper surface.

In another example, the spacer of the second hole punching plate assembly has a lower surface contacting the base plate and an opposing curved upper surface, a curvature of the curved upper surface being configured to support the decorative article.

The spacer of the second hole punching plate assembly may be made of a rigid plastic, for example.

Another embodiment is directed to a snap setting assembly for preparing articles with stud and post snap fasteners for receiving decorative patches equipped with matching cap and socket snap fasteners. The snap setting assembly may comprise a first snap setting plate assembly including a stud plate and a plurality of stud setters mounted to the stud plate in a regular pattern and extending away from a first surface of the stud plate, and a second snap setting plate assembly including a post anvil plate, a corresponding plurality of post anvils mounted to the post anvil plate in the regular pattern and extending away from a first surface of the post anvil plate, and a snap setting spacer positioned around the plurality of post anvils on the first surface of the post anvil plate, wherein the plurality of stud setters are positioned such that they are centered on the corresponding post anvils when the first and second snap setting plate assemblies are placed together with the plurality of stud setters contacting the plurality of post anvils.

In one example, the stud plate and the post anvil plate are metal plates.

In another example, the first snap setting plate assembly further includes a first mounting pin extending from a second, opposing surface of the stud plate.

In another example, the second snap setting plate assembly further includes a second mounting pin extending away from a second, opposing surface of the post anvil plate, and wherein the post anvil plate includes a flange having a hole therein.

The snap setting assembly may further comprise a press tool configured to receive the first and second snap setting plate assemblies, the press tool having a movable portion and a base positioned below the movable portion, wherein the first snap setting plate assembly is configured to be attached to the movable portion using the first mounting pin, and the second snap setting plate assembly is configured to be attached to the base using the second mounting pin and the flange, such that the first and second snap setting plate assemblies are aligned with one another, each of the plurality of stud setters being centered and aligned with respect to corresponding ones of the plurality of post anvils. The press tool may be configured to be operable, when an article is positioned between the first and second snap setting plate assemblies, to lower the first snap setting plate assembly toward the second snap setting plate assembly with sufficient force such that the plurality of stud setters set studs of the stud and post snap fasteners on the article into posts of the stud and post snap fasteners to secure the stud and post snap fasteners to the article.

In one example, the plurality of stud setters consists of four stud setters, and wherein the plurality of post anvils consists of four post anvils, the regular pattern being a rectangular pattern.

According to another embodiment, a removable decorative patch system comprises a flat-brimmed hat having a front surface and a plurality of snap fasteners secured to flat-brimmed hat and arranged in a regular pattern on the front surface, and a decorative patch having a front surface with a decoration, and a corresponding plurality of mating snap fasteners secured to the decorative patch and arranged in the regular pattern, the decorative patch being removably attachable to the flat-brimmed hat by connecting the plurality of snap fasteners to the plurality of mating snap fasteners.

In one example, the decorative patch is a rectangular patch, the regular pattern is a rectangular pattern, and the pluralities of snap fasteners and mating snap fasteners each consist of four fasteners, with the plurality of mating snap fasteners being arranged proximate corners of the rectangular patch. In another example, the snap fasteners on the flat-brimmed hat are stud and post fasteners arranged and secured such that studs of the stud and post fasteners extend from the front surface of the flat-brimmed hat, wherein the mating snap fasteners on the decorative patch are cap and socket fasteners, with caps of the cap and socket fasteners being positioned on the front surface and sockets of the cap and socket fasteners being positioned on a reverse surface of the decorative patch and configured to mate with the studs so as to removably attach the decorative patch to the flat-brimmed hat. In another example, the four mating snap fasteners are arranged in the regular pattern on the decorative patch with a first horizontal spacing and a first vertical spacing, and the four snap fasteners are arranged in the regular pattern on the front surface of the flat-brimmed with a second horizontal spacing and a second vertical spacing, the second horizontal spacing being different from the first horizontal spacing. According to certain examples, the removable decorative patch system may further include a bag having a front surface and a second plurality of snap fasteners secured to the bag and arranged in the regular pattern on the front surface of the bag with the first horizontal spacing and the second vertical spacing, wherein the decorative patch is removably attachable to the bag by connecting the second plurality of snap fasteners to the first plurality of mating snap fasteners.

Another embodiment is directed to an apparatus for preparing a host article and a decorative patch for removable attachment to one another using snap fasteners. The apparatus may comprise a pair of matching hole punching plate assemblies configured to be used with a press tool to punch a first pattern of holes into the host article and to punch a second pattern of holes into the decorative patch, and a first pair of stud setting plate assemblies configured to simultaneously set a plurality of stud and post snap fasteners into the host article at locations corresponding to the first pattern of holes in the host article.

According to another embodiment, an apparatus for preparing a plurality of host articles and decorative patches for removable attachment to one another using snap fasteners comprises a set of matching hole punching plate assemblies configured to be used with a press tool to punch a first pattern of holes into a first host article, to punch a second pattern of holes into a decorative patch, and a corresponding set of stud setting plate assemblies configured to simultaneously set a first plurality of stud and post snap fasteners into the first host article at locations corresponding to the first pattern of holes in the host article, and to simultaneously set a plurality of cap and socket snap fasteners into the decorative at locations corresponding to the second pattern of holes in the decorative patch. The first and second patterns of holes are arranged such that the first plurality of stud and post snap fasteners are configured to mate with the plurality of cap and socket snap fasteners to removably attach the decorative patch to the first host article.

In one example, the set of hole punching plate assemblies includes a first hole punching plate assembly including a plate, a plurality of hole punchers attached to the plate, and an alignment spacer attached to the plurality of hole punchers and spaced apart from the plate, the plurality of hole punchers being arranged in the first pattern on a first side of the plate and extending beyond the alignment spacer, and a second hole punching plate assembly including a base plate and a plurality of receiving pads mounted on the base plate and arranged in the regular pattern on a first side of the base plate, a number of the plurality of receiving pads corresponding to a number of the plurality of hole punchers, the second hole punching plate assembly further including a spacer positioned around the plurality of receiving pads on the first side of the base plate. In one example, the spacer of the second hole punching plate assembly has a lower surface contacting the base plate and an opposing substantially flat upper surface. In another example, the spacer of the second hole punching plate assembly has a lower surface contacting the base plate and an opposing curved upper surface, a curvature of the curved upper surface being configured to support the first host article. In certain examples in which the first host article has a curved surface into which the first pattern of holes is punched, the first pattern is a rectangular pattern having a first horizontal hole spacing and a first vertical hole spacing, and the second pattern is a rectangular pattern having a second horizontal hole spacing and second vertical hole spacing; the first and second horizontal hole spacings being different by an amount determined by a curvature of the curved surface of the first host article.

In one example, the spacer of the second hole punching plate assembly is made of a rigid plastic.

Still other aspects, embodiments, and advantages of these exemplary aspects and embodiments are discussed in further detail below. Embodiments and implementations disclosed herein may be combined with other embodiments and implementations in any manner consistent with at least one of the principles disclosed herein.

BRIEF DESCRIPTION OF THE DRAWINGS

Various aspects of at least one embodiment are discussed below with reference to the accompanying figures, which are not intended to be drawn to scale. The figures are included to provide illustration and a further understanding of the various aspects and embodiments, and are incorporated in and constitute a part of this specification, but are not intended as a definition of the limits of the invention. In the figures, each identical or nearly identical component that is illustrated in various figures is represented by a like numeral. For purposes of clarity, not every component may be labeled in every figure. In the figures.

DETAILED DESCRIPTION

Aspects and embodiments are directed to systems and methods for decorating or embellishing clothing and/or accessories such as bags, hats, belts, and the like, using interchangeable decorative patches that can be removably attached to different articles. A system of "snap" fasteners, or similar devices, is used to allow the patches to be securely yet removably attached to articles that have been prepared with matching fasteners. Certain embodiments provide a method of preparing the articles and patches for attachment to one another in a manner that ensures consistent, accurate spacing of the fasteners, allowing for smooth, well-fitting attachments and a high-quality look and feel to the end products.

Figure 1A:
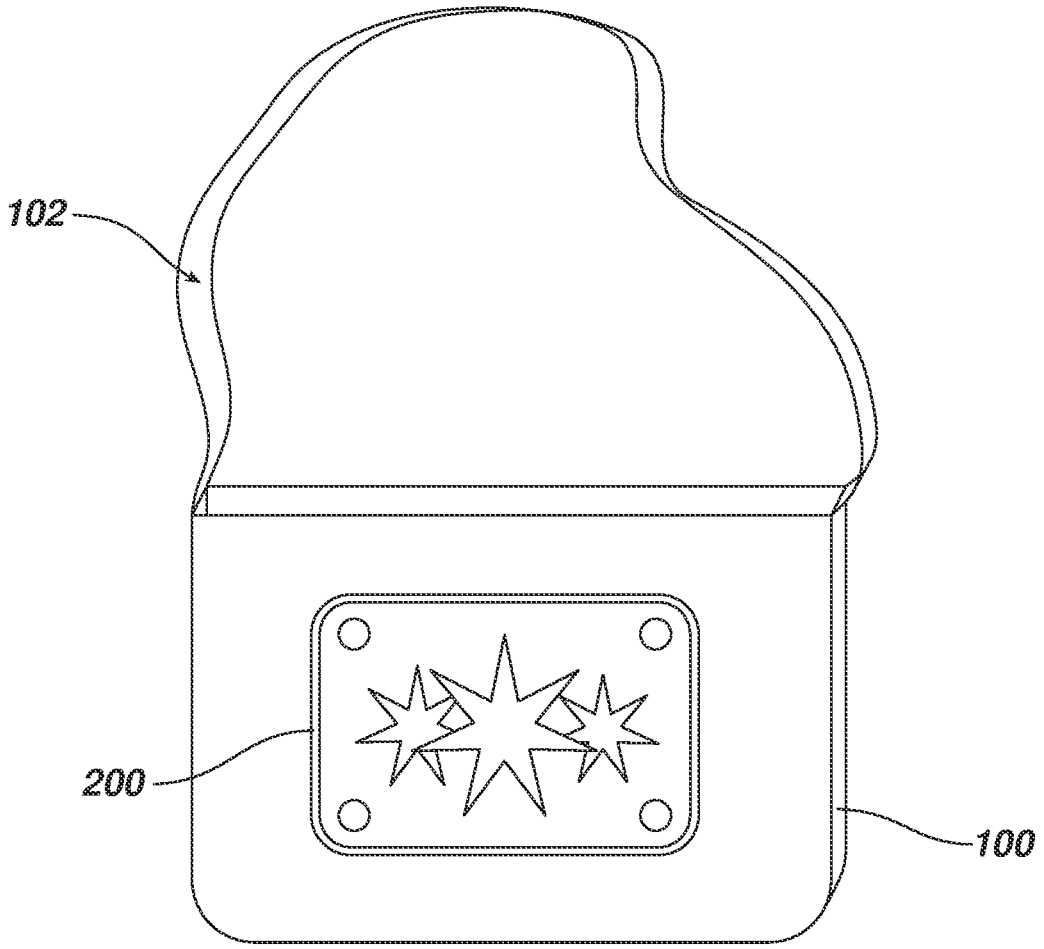
FIG. 1A is a diagram of one example of a host article including an attached decorative patch according to certain embodiments.
Figure 1B:
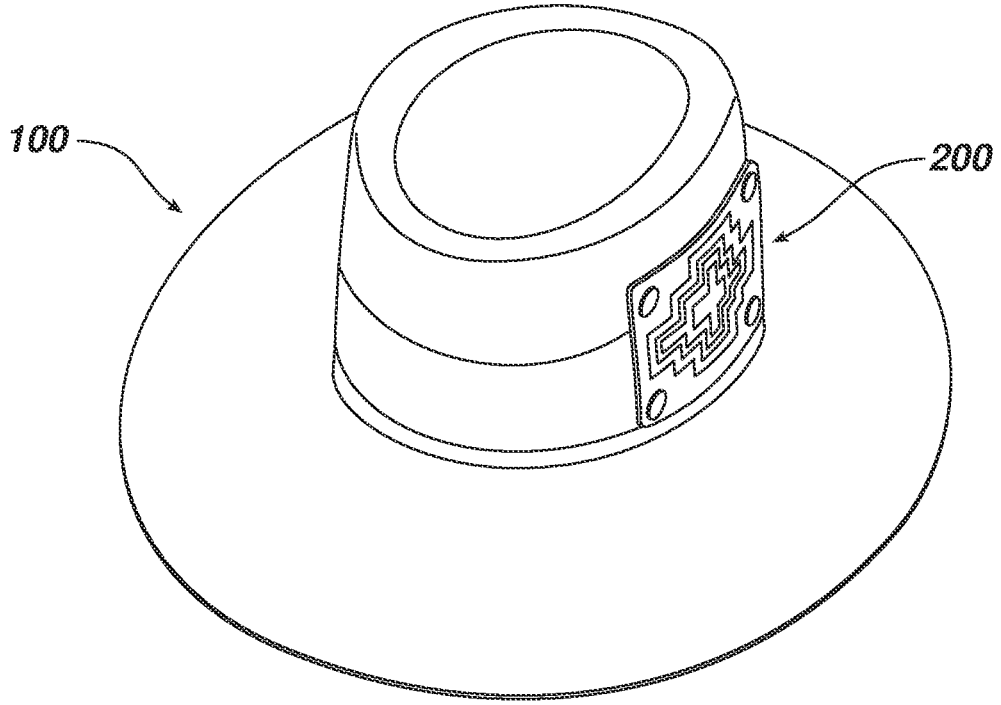
FIG. 1B is an image showing another example of a host article including a decorative patch according to certain embodiments.

Referring to FIG. 1, there is illustrated an example of a host article 100 having an attached decorative patch 200 according to certain embodiments. The decorative patch 200 may be made of leather or cloth, for example. In the illustrated example, the host article 100 is a bag having a shoulder strap 102. However, in other examples, the host article 100 may be any of many other types of accessories and/or articles of clothing, including, but not limited to, hats of many different styles (such as flat-brimmed hats, stocking hats, fedora hats, caps, etc.), belts, bags or purses of many different styles and shapes, jackets, and the like. For example, FIG. 1B shows an example in which the host article 100 is a flat-brimmed hat. As used herein, the term "host article" is intended to refer to any such accessory or article of clothing that is prepared with fasteners (as shown in FIG. 2 and discussed in more detail below) to accept one or more decorative patches 200.

Figure 2:
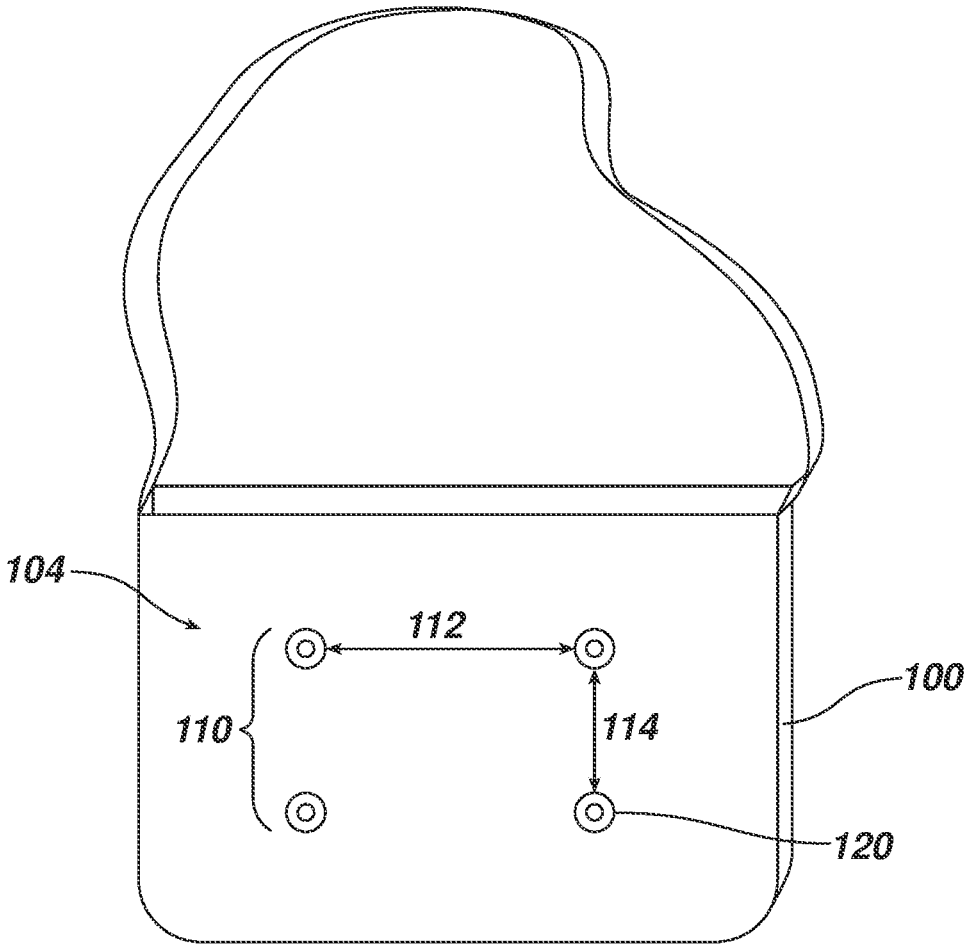
FIG. 2 is a diagram showing the host article of FIG. 1A with a pattern of host fasteners for attaching decorative patches according to certain embodiments.
Figure 3A:
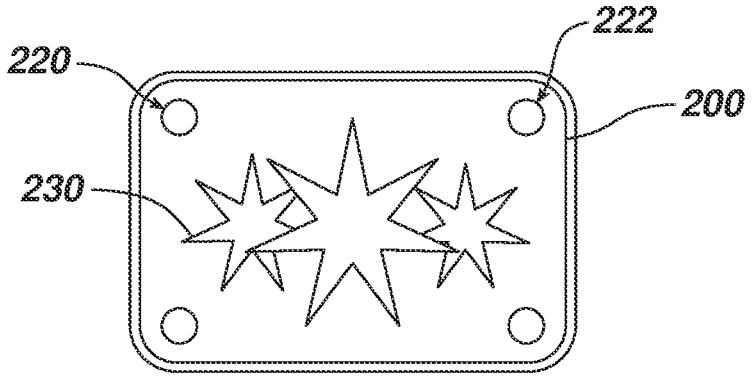
FIG. 3A is a top view of the front side of one example of a decorative patch according to certain embodiments.
Figure 3B:
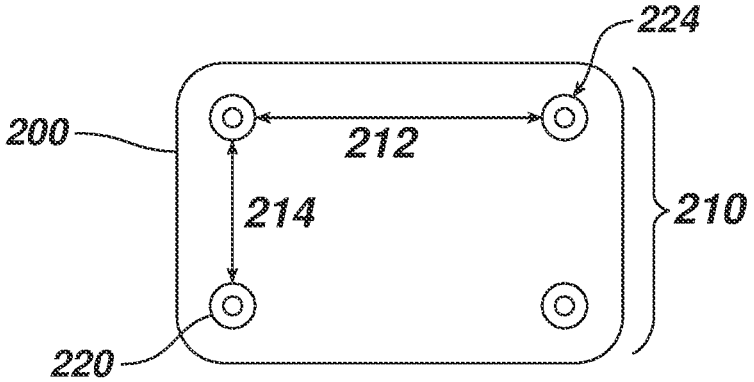
FIG. 3B is a top view of the reverse side of the decorative patch of FIG. 3A showing an example of a pattern of patch fasteners according to certain embodiments.
Figure 4A:
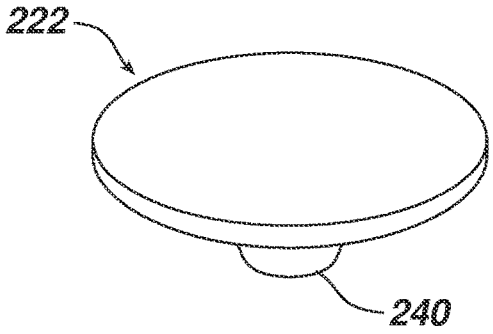
FIG. 4A is an image of one example of a cap portion of a snap fastener set according to certain embodiments.
Figure 4C:
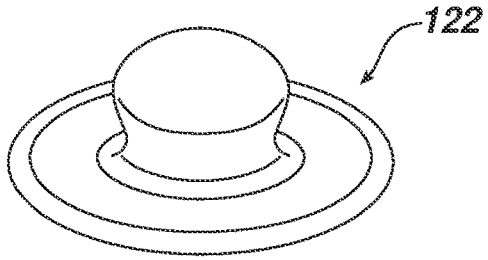
FIG. 4C is an image of one example of a stud portion of a snap fastener set according to certain embodiments.
Figure 4B:
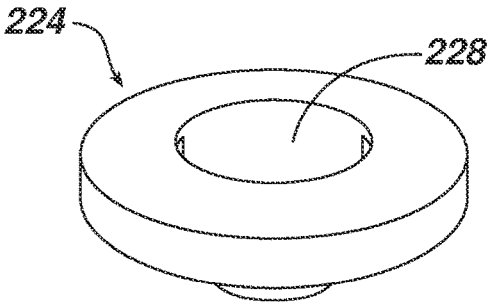
FIG. 4B is an image of one example of a socket portion of a snap fastener set according to certain embodiments.
Figure 4D:
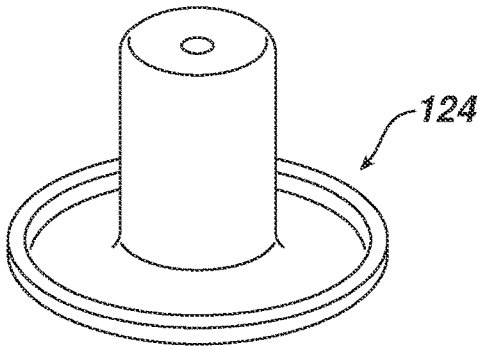
FIG. 4D is an image of one example of a post portion of a snap fastener set according to certain embodiments.

Referring to FIG. 2, the host article 100 has a front surface 104 (where the decorative patch 200 will be attached) that is prepared with a host pattern 110 of host fasteners 120. Methods for preparing the host article 100 are described further below. Similarly, referring to FIGS. 3A and 3B, the decorative patch 200 is prepared with a corresponding patch pattern 210 of matching/mating patch fasteners 220. Methods for preparing the decorative patch 200 are described further below. FIG. 3A shows an example of the front side of the decorative patch 200 having a decoration 230, and FIG. 3B shows an example of the reverse side of the decorative patch 200. The decoration 230 may include any variety or type of decorative pattern(s), shape(s), symbol(s), image(s), and the like. Further, although the decorative patch 200 is referred to herein as "decorative," this terminology is not intended to preclude the decorative patch 200 and the decoration 230 from performing a function besides aesthetic decoration or embellishment. For example, in certain embodiments the decorative patch 200 may perform an identification function, and the decoration 230 may include identifying text (such as a name, for example), symbol(s), and/or a logo.

In the examples shown in FIGS. 1A, 1B, 3A, and 3B, the decorative patch 200 has a rectangular shape, and therefore the host and patch patterns 110, 210 of the host fasteners 120 and patch fasteners 220, respectively, are also rectangular. For example, as shown in FIGS. 3A and 3B, the pattern 210 may include four patch fasteners 220 positioned near the four corners of the decorative patch 200. Such an arrangement and pattern 210 may be advantageous for a roughly rectangular decorative patch 200 by providing secure attachment that allows the decorative patch 200 to lie flat against the host article 100 without excessive material to the "outside" of the attachment pattern that could flap, hang away from the host article 100, or be caught on objects, potentially causing the decorative patch 200 to become accidentally detached from the host article 100. In the example of FIG. 3B, the four patch fasteners 220 are arranged in a rectangular pattern 210 with a horizontal patch fastener spacing ($S_{pH}$) 212 and a vertical patch fastener spacing ($S_{pv}$) 214. Accordingly, as shown in FIG. 2, in this example, on the host article 100, there are four host fasteners 210 arranged in a rectangular pattern 110 with a horizontal host fastener spacing ($S_{hH}$) 112 and a vertical host fastener spacing ($S_{hv}$) 114. In some examples, the horizontal patch fastener spacing 212 and the horizontal host fastener spacing 112 are the same, and the vertical patch fastener spacing 214 and vertical host fastener spacing 114 are also the same. However, in other examples, depending on the type of host article 100, the horizontal and/or vertical spacings of the host fasteners 120 and the patch fasteners 220 may be different, as discussed in more detail below. Further, in various embodiments, the decorative patches 200 may be shaped differently, and need not necessarily be rectangular. Accordingly, the fastener patterns 110, 210 may be adjusted to best suit the shape and size of the decorative patch 200. For example, where the decorative patch 200 may have a triangular shape, patterns 110, 210 of three host fasteners 120 and patch fasteners 220, respectively, may be used, with a fastener placed near each of the three corners of the triangle. In examples where the decorative patches may be "thin" rectangles, or strips, patterns 110, 210 of two fasteners may be sufficient. For large decorative patches, it may be preferable to use patterns 110, 210 of more than four fasteners. Those skilled in the art will appreciate, given the benefit of this disclosure, that a wide variety of patch shapes and sizes may be implemented, with a corresponding wide variety of different fastener patterns. Thus, while the following description may refer primarily to rectangular patches and corresponding rectangular patterns of four fasteners, this description is for the purposes of explanation and illustration, and not intended to be limiting. The principles and aspects of the apparatus and methods discussed herein may be suitably adapted and applied to any shape or size of decorative patch 200 and corresponding fastener patterns 110,210.

The host fasteners 120 and the patch fasteners 220 may include any type of suitable mating fastener pairs that allow the decorative patch 200 to be securely but removably attached to the host article 100. In one example, the host fasteners 120 and the patch fasteners 220 are snap fasteners. FIGS. 4A-D illustrate an example of a set of snap fasteners that can be used as the host fasteners 120 and the patch fasteners 220. In this example, each of the patch fasteners 220 includes a cap 222 (FIG. 4A) and socket 224 (FIG. 4B) pair, and each of the host fasteners 120 includes a stud 122 (FIG. 4C) and post 124 (FIG. 4D) pair. To prepare the decorative patch 200 using the cap 222 and socket 224 pair of FIGS. 4A and 4B, a hole is made at each patch fastener location in the patch pattern 210, and each patch fastener 220 is attached by placing the cap 222 on the front side of the decorative patch 200 (FIG. 3A) at the hole location, placing the socket 224 on the reverse side of the decorative patch 200 (FIG. 3B) at the hole location, and setting the cap 222 to the socket 224, as described further below. Similarly, to prepare the host article 10 using the stud 122 and post 124 pair of FIGS. 4C and 4D, a hole is made at each host fastener location in the host pattern 110, and each host fastener 120 is attached by placing the stud 122 on the outside (where the decorative patch 200 is to be attached; FIG. 2) of the host article 100 at the hole location, placing the post 124 on the opposite side, possibly interior, of the host article 100 at the hole location, and setting the stud 122 to the post 124, as described further below. Thus, the host article 100 is prepared with the studs 122 of the host fasteners available at the area where the decorative patch 200 is to be attached (as shown in FIG. 2), and the decorative patch can be attached to the host article by "snapping" the studs 122 into the sockets 224 of the patch fasteners 220. It may be possible to reverse the connections, and use the cap and socket pair as the host fastener 120 and the stud and post pair as the patch fastener 220; however, it may be more desirable in many applications to use the connection arrangement discussed above such that the cap 222 is visible on the front side of the decorative patch 200 when the decorative patch 200 is attached to the host article 100, as shown in FIGS. 1A and 1B, as this may present a more visually appealing finish.

Aspects and embodiments are directed to methods for preparing the decorative patches 200 and host articles 100 for removable and interchangeable attachment to one another using fasteners such as the snap fastener set shown in FIGS. 4A-D or similar reusable fastener sets. The host fasteners 120 and patch fasteners 220 may be applied individually to the host article 100 and decorative patch 200, respectively, either manually (e.g., by sewing) or using an attachment tool. However, securing the host fasteners 120 and patch fasteners 220 individually, one at a time, maybe time consuming and prone to alignment errors. Even slight variations in any of the horizontal host fastener spacing 112, vertical host fastener spacing 114, horizontal patch fastener spacing 212, and/or vertical patch fastener spacing 214 from one decorative patch 200 to another or from one host article 100 to another can cause the decorative patch 200 to not lie flat or smoothly against the host article 100 when attached (or even be prevented from being properly attached at all), leading to diminished quality and a less appealing appearance. Aspects and embodiments address this problem by providing methods of preparing the decorative patches 200 and host articles 100 in which the fastener patterns 110, 210 are each produced as a complete set, and all the fasteners in a given fastener pattern 110 or 210 are attached to the host article 100 or decorative patch 200, respectively, simultaneously, thus removing the inconsistencies associated with attaching each fastener individually and significantly increasing the speed of production.

According to certain embodiments, decorative patches 200 and host articles 100 may be prepared in "lines." In each line, all decorative patches 200 have the same patch fastener pattern 210, and all host articles 100 have corresponding host fastener patterns 110, which may be slightly different from the corresponding patch fastener pattern 210, depending on the type of host article 100, as discussed further below, but which all allow for proper attachment of any of the decorative patches 200 in the line. Thus, within a line, multiple different decorative patches 200 can be interchangeably used and reused with various different host articles 100. Below are discussed methods and apparatus for preparing a line of decorative patches 200 and corresponding host articles 100. In the examples discussed below, the decorative patches 200 are rectangular, having the patch pattern 210 of four patch fasteners 220 shown in FIGS. 1A-3B and using the cap 222 and socket 224 pair of the fastener set shown in FIGS. 4A and 4B. Thus, the host articles 100 also have the rectangular host pattern 110 of four host fasteners 120 shown in FIGS. 1A and 2 and use the stud 122 and post 124 pair of the fastener set shown in FIGS. 4C and 4D. However, those skilled in the art will appreciate, given the benefit of this disclosure, that different lines of decorative patches and corresponding host articles can be prepared using variations of the methods and apparatus to accommodate different decorative patch styles and fastener patterns as discussed above.

Figure 5:
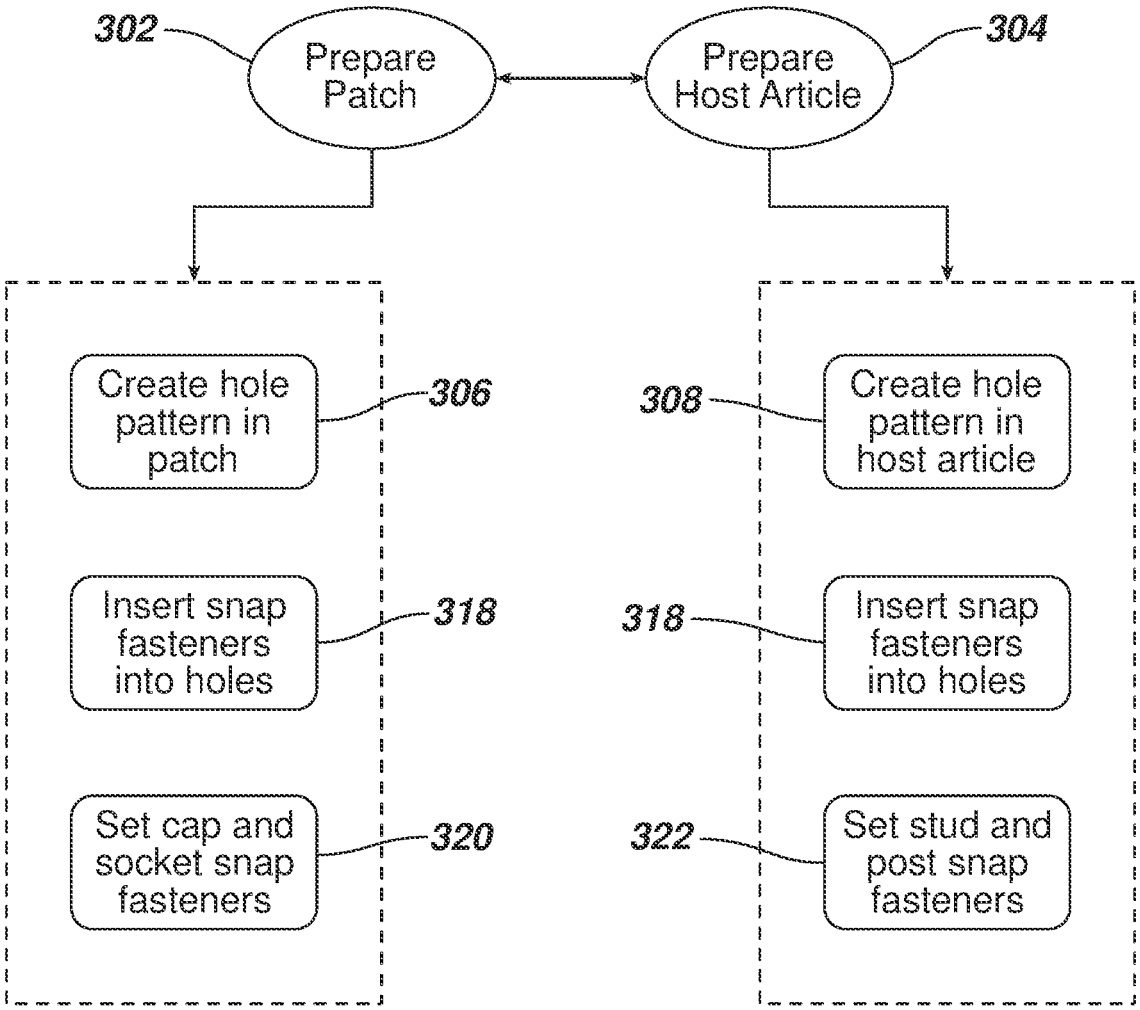
FIG. 5 is a flow diagram of one example of a method for preparing a line of host articles and decorative patches according to certain embodiments.

Referring to FIG. 5, a method of preparing a line includes a process 302 of preparing a decorative patch 200 and a process 304 of preparing a host article. The processes 302 and 304 maybe performed in either order, simultaneously, or with intermingled steps.

Process 302 of preparing the decorative patch 200 includes a first step 306 of creating a set of holes in the decorative patch 200, the holes being arranged corresponding to the patch fastener pattern 210. The patch fasteners 220 will be secured to the decorative patch 200 at the locations of the holes. Similarly, the process 304 of preparing the host article 100 includes a first step 308 of creating holes corresponding to the fastener pattern 110 in the host article 100. According to certain embodiments, the holes in both the host article 100 and the decorative patch 200 can be produced using a hole punching apparatus. An example of a hole punching apparatus is shown in FIGS. 6A and 6B.

Figure 6A:
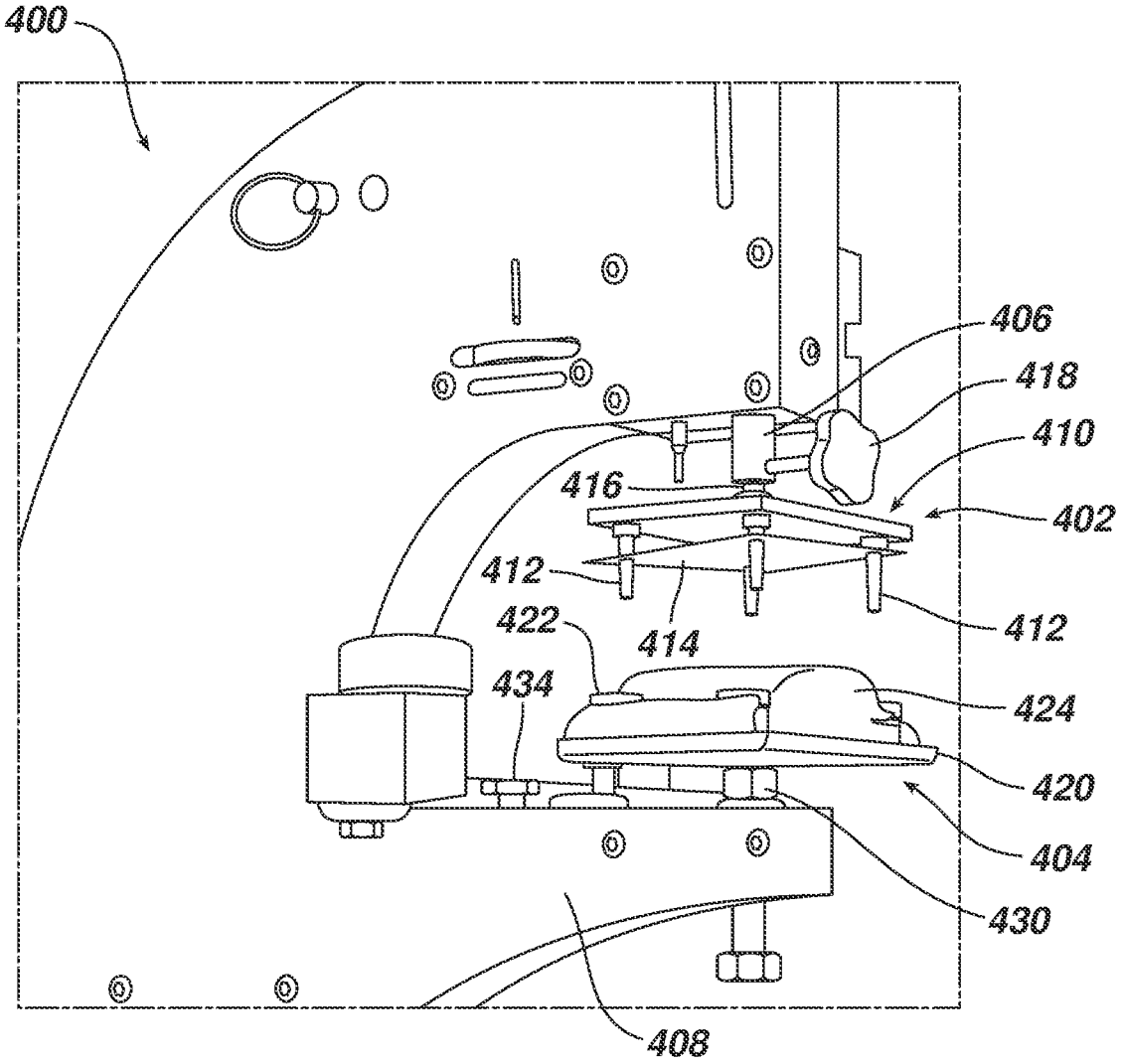
FIG. 6A is an image of one example of a hole punching apparatus according to certain embodiments.
Figure 6B:
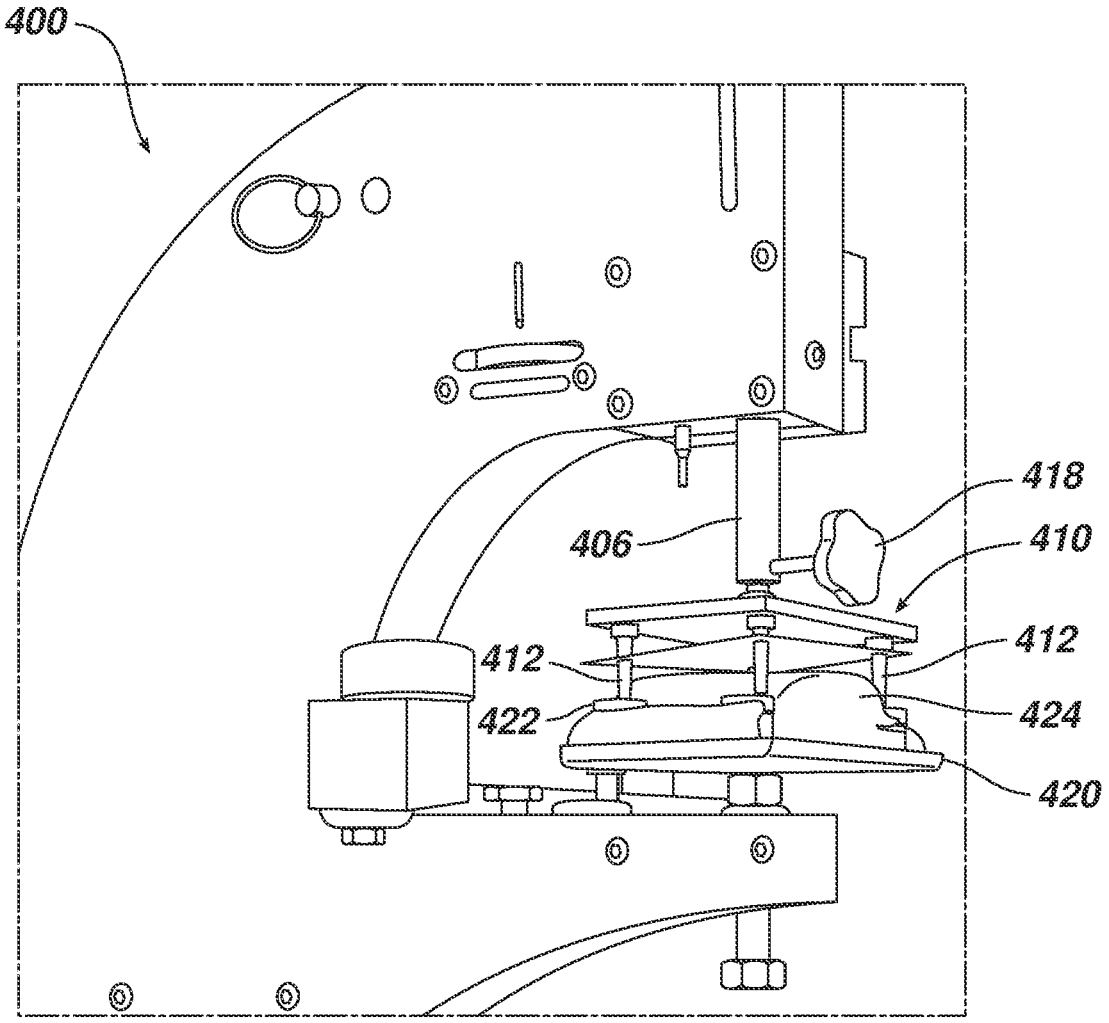
FIG. 6B is an image of the hole punching apparatus of FIG. 6A, showing the movable portion of the press tool in an extended/lowered position.

Referring to FIG. 6A, in one embodiment, the hole punching apparatus includes a press tool 400, a top hole punching plate assembly 402, and a bottom hole punching plate assembly 404. The press tool 400 has an upper arm including a movable portion 406 that is configured to receive the top hole punching plate assembly 402, and a lower arm or base 408 configured to receive the bottom hole punching plate assembly 404. To create the holes in either the host article 100 or the decorative patch 200, the host article 100 or decorative patch 200 is placed between the top hole punching plate assembly 402 and the bottom hole punching plate assembly 404, and the press tool 400 is operated to move the top hole punching plate assembly 402 downwards to engage the bottomhole punching plate assembly 404 with sufficient force to punch holes into the article, as discussed further below. The press tool 400 may be any type of manual, electronic, or hydraulic press tool. In one example, the press tool 400 includes a foot pedal (not shown) that may be pressed or otherwise operated by a user to cause the movable portion 406 to extend and lower the top hole punching plate assembly 402 to engage the bottom hole punching plate assembly 404 (as shown in FIG. 6B) to effect the hole punching action. In other examples the press tool 400 may include a lever or other mechanism that can be operated by hand to achieve the hole punching, or may be operable under the control of a computer or other electronic apparatus.

According to certain embodiments, the top hole punching plate assembly 402 includes a plate 410 having a plurality of hole punchers 412 attached thereto. The top hole punching plate assembly 402 may also include an alignment piece 414, which in certain examples is made of plastic. The alignment piece 414 may include various lines or other marks that can be used to visually align the host article 100. The plate 410 may be a metal plate, for example. In the illustrated example, the plate 410 is a rectangular plate; however, other shapes may be used in other examples. The plurality of hole punchers 412 are arranged in a pattern corresponding to the hole/fastener) pattern 110 or 210 to be used for the host article 100 or decorative patch 200, respectively. In the illustrated example, the top hole punching plate assembly 402 includes four hole punchers 412; however, other arrangements may be implemented depending on the desired fastener patterns 110, 210, as discussed above. The hole punchers 412 may be secured to the plate 410 using any suitable mechanism, such as by screwing or bolting them to the plate 410. The top hole punching plate assembly 402 is attached to the movable portion 406 of the press tool 400. In one example, the top hole punching plate assembly 402 includes a pin or rod 416 that can be inserted into an opening in the movable portion 406 and secured by tightening a clamp 418, as shown in FIGS. 6A and 6B.

Figure 7:
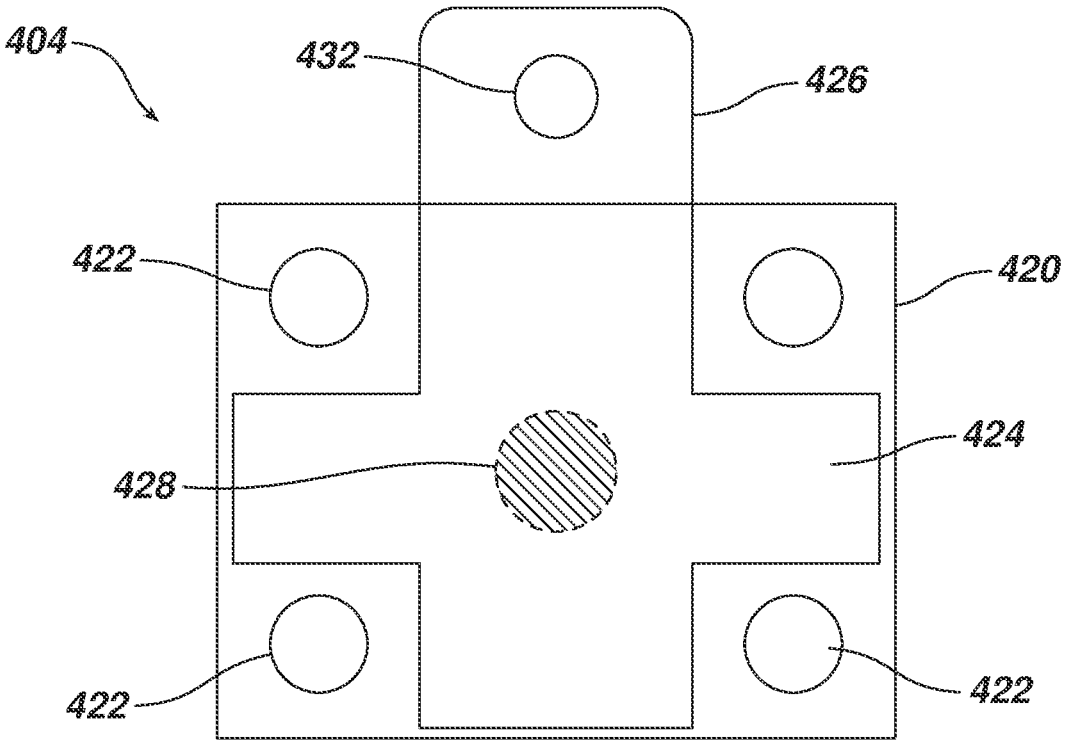
FIG. 7 is a top view of one example of a bottom hole punching plate assembly 404 according to certain embodiments.

The bottom hole punching plate assembly 404 may include a base plate 420, a plurality of receiving pads 422, and a spacer 424. The receiving pads 422 are arranged to be aligned with the hole punchers 412 of the top hole punching plate assembly when the press tool 400 is operated such that the top hole punching plate assembly 402 lowers and engages the bottom hole punching plate assembly 404, as shown in FIG. 6B. FIG. 7 is a top view of one example of a bottom hole punching plate assembly 404 according to certain embodiments. The base plate 420 may be a metal plate. The receiving pads 422 may also be made of metal (e.g., brass), and may be secured to the base plate 420 using any suitable attachment means. In certain examples, the receiving pads 422 may be screwed into the base plate 420. In the illustrated example, the receiving pads 422 are circular in shape; however, in other examples they may have a different shape (e.g., rectangular, square, oval, etc.). The spacer 424 is arranged around the receiving pads 422 as shown, and may or may not contact the edges of the receiving pads 422. In certain examples, the spacer 424 may be made of a rigid material, such as polycarbonate, a hard plastic, plexiglass, a rigid foam, and the like. The base plate 420 may include a flange 426 to facilitate securing the bottom hole punching plate assembly 404 to the lower arm 408 of the press tool 400. The bottom hole punching plate assembly 404 may further include a pin or rod 428 extending from or attached to the underside of the base plate 420 that is also used to secure the bottom hole punching plate assembly 404 to the lower arm 408 of the press tool 400. For example, referring to FIGS. 6A and 7, the bottom hole punching plate assembly 404 may be secured to the arm 408 by placing and aligning the bottom hole punching plate assembly 404 such that the pin 428 fits inside a hole (not shown) in the arm 408 and can be secured in place by tightening a fastener 430. Further, the bottom hole punching plate assembly 404 can be aligned on the arm 408 such that a hole 432 in the flange 426 aligns with another hole (not shown) in the arm 408, and the base plate 420 can be fixed in place using a fastener 434, such as a screw or bolt, that passes through both holes and, if necessary, can be tightened with a nut or similar device. In this manner, the bottom hole punching plate assembly 404 can be securely fastened in place such that it does not move during operation of the press tool 400 and is well aligned with the top hole punching plate assembly 402.

Figure 8:
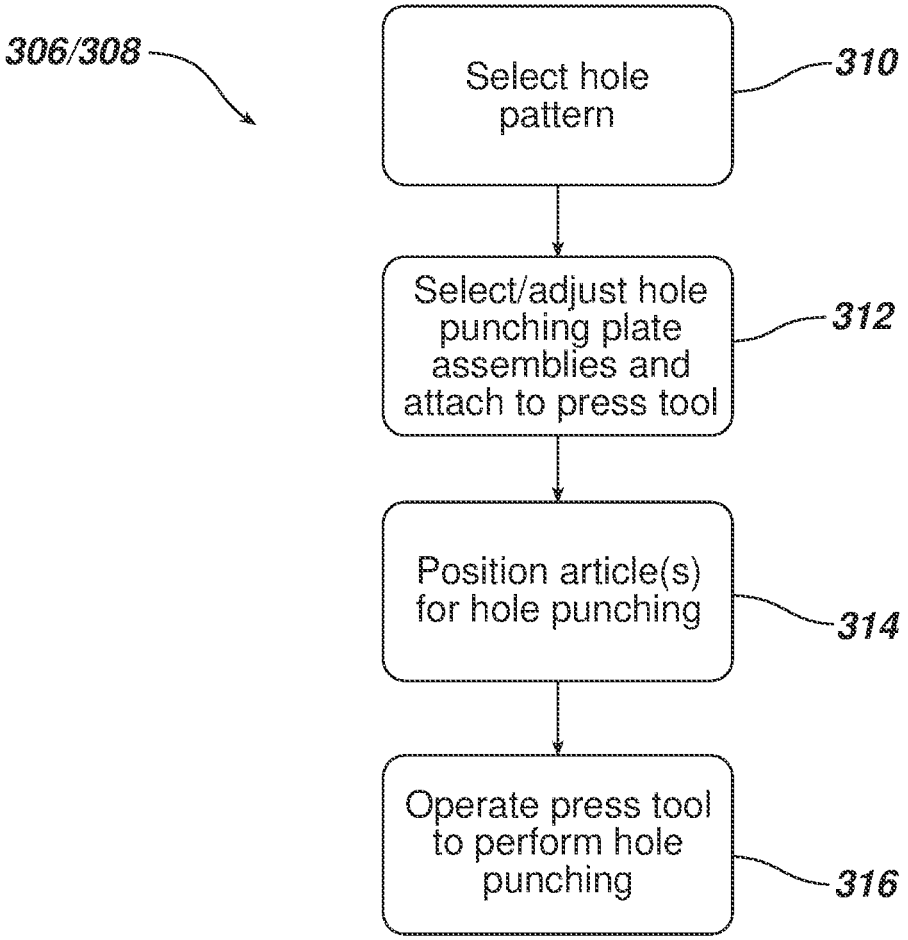
FIG. 8 is a flow diagram of one example of a hole punching process according to certain embodiments.

FIG. 8 is a flow diagram of one example of a method of operating the hole punching apparatus to create the patterns 110 or 210 of holes in the host article 100 (step 308) or decorative patch 200 (step 306), respectively. A first step 310 includes selecting a desired hole pattern to be produced in the host article 100 or decorative patch 200. As discussed above, the hole patterns 110, 210 may vary between different lines of host articles 100 and decorative patches 200, and also may vary depending on whether step 306 or step 308 is being performed. Once the desired hole pattern is selected, the appropriate top and bottom hole punching plate assemblies 402, 404 can be selected and/or adjusted and attached to the press tool 400 (step 312).

Figure 9A:
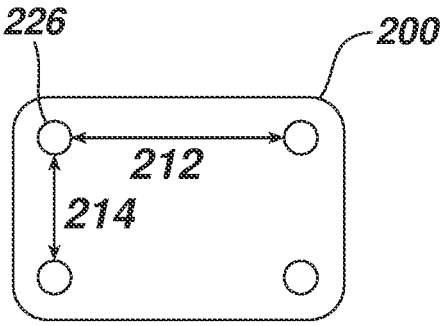
FIG. 9A is a diagram of one example of a decorative patch having a hole pattern formed therein, according to certain embodiments.

As discussed above, in certain examples, the fastener pattern 210 on the decorative patch 200 has a horizontal patch fastener spacing 212 and a vertical patch fastener spacing 214. The center-to-center fastener spacings correspond to the center-to-center hole spacings produced in step 306. FIG. 9A shows an example of a decorative patch 200 with holes 226 arranged according to the patch fastener pattern 210 discussed above. To perform step 306 of punching the holes 226 in the decorative patch 200, a top hole punching plate assembly 402 is selected and/or configured with the hole punchers 412 set to produce the holes 226 with the correct horizontal and vertical spacings 212, 214. The spacings 212, 214 should be selected such that the fasteners sit entirely within the outer boundary of the decorative patch 200 (and not "overhang" the edges at all) and are vertically and horizontally centered with respect to one another, as shown in FIG. 9A. The hole punchers 412 may be selected depending on the thickness of the article being hole punched. In certain examples, two or more decorative patches can be hole punched at the same time. In such cases, longer hole punchers 412 may be used than when a single decorative patch 200 is hole punched alone. As discussed above, in certain examples, the hole punchers 412 may be screwed into or otherwise removably attached to the plate 410 and therefore may be easily changed for different hole punching applications. In certain examples in which the decorative patch 200 may have a thickness of approximately $1/8^{th}$ of an inch, the lengths of the hole punchers 412 may be in a range of about 0.5-1.0 inches. The diameters of the hole punchers 412 may be selected based on the size of the snap fasteners to be installed, and typically may be on the order of a few $16^{th}$s of an inch, although larger diameters may be used for larger fasteners.

As discussed above, according to various aspects and embodiments, the same decorative patch 200 can be removably attached to and detached from multiple different host articles 100 which may be of the same type (e.g., multiple different bags) or different types (e.g., different bags and hats, for example). Similarly, multiple different decorative patches 200 can be removably attached to and detached from the same host article 100. The fastener patterns 210 and hole patterns 110 may be carefully selected to accommodate this interchangeability, while providing a smooth, well-fitted finish between the decorative patch 200 and the host article 100 in each case, even when the decorative patch 200 is used on different host articles 100 of different types and shapes.

Figure 9B:
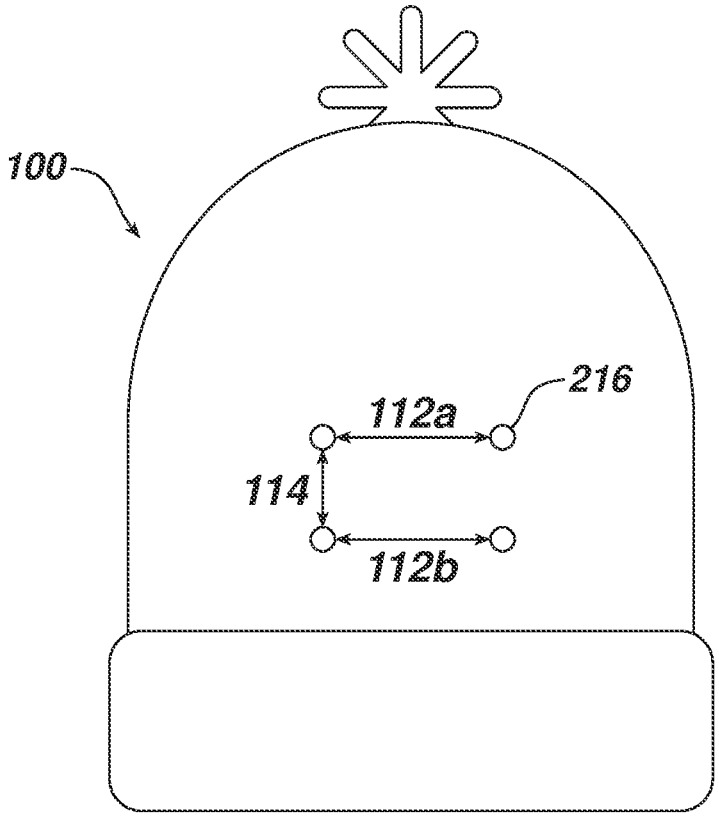
FIG. 9B is a diagram of one example of a host article having a hole pattern formed therein, according to certain embodiments.

If the area of the host article 100 where the hole pattern is being formed is substantially flat, the same top hole punching plate assembly 402 that is used to punch the hole pattern 210 in the decorative patch 200 may be used to punch the hole pattern 110 in the host article 100. The hole punchers 412 may be of different lengths depending on the different thicknesses of the articles to be hole punched. In other examples, the horizontal spacing 112 on the host article 100 may be different from the horizontal spacing 212 on the decorative patch and/or the vertical spacing 114 may be different from the vertical spacing 214. This may be the case when the host article has some curvature, particularly when in use. For example, FIG. 9B shows an example in which the host article 100 is a hat. In this example, even if the hat is flat at the time when the decorative patch 200 is attached, it is curved when worn by a user. In such and similar examples, the host horizontal spacing 112 needs to be slightly different from the patch horizontal spacing 212 to account for the curvature; otherwise the decorative patch 200 will not lie flat against the hat during use. Similarly, the vertical spacing 114 may need to be different from the patch vertical spacing 214 to account for the curvature. Furthermore, the curvature of the hat may not be uniform over the front surface 104 where the decorative patch 200 is to be attached. In certain examples, the top horizontal spacing 112*a* may be different from the bottom horizontal spacing 112*b* because the top and bottom curvatures are different. Even small differences in the spacings, for example, ¼ inch, $\frac{1}{8}^{th}$ of an inch, $\frac{1}{16}^{th}$ of an inch, or even $\frac{1}{32}^{nd}$ of an inch, can be make a noticeable difference in how well the decorative patch 200 fits with the host article 100. For example, the difference between the hole spacings on the decorative patch 200 and the corresponding host hole spacings on a hat with the most vertical curvature and different horizontal curvatures (such as a stocking cap, for example, as shown in FIG. 9B) may be on the order of a few $32^{nds}$ of an inch to a few $16^{ths}$ of an inch. Although these differences may seem small, carefully selecting the different hole spacings, to within very small tolerances (e.g., as little as $\frac{1}{32}^{nd}$ of an inch in some examples) may be very important to ensuring a neat, well-fitted match between the decorative patch 200 and the host article.

Thus, a unique aspect of the methods and apparatus described herein is the recognition of the importance of the hole spacings on the host article 100 relative to those on the decorative patch 200, and the selection/adjustment of the hole punching apparatuses to account for the differences in hole spacings needed to produce high quality, accurate matches and fit between the decorative patch 200 and various host articles 100 with different curvatures. In certain examples, the vertical and horizontal hole spacings on the decorative patch 200 and the host article 100 are determined based on the size of the decorative patch and the curvature (s), if any, of the front surface 104 of the host article 100, and may be selected within a tolerance of ¼ of an inch. In certain examples, variations in the desired spacings of greater than ¼ inch may cause an unacceptable misfitting between the decorative patch 200 and the host article 100. In other examples, the spacing tolerance may be $\frac{1}{8}^{th}$ of an inch. More preferably, the spacing tolerance may be $\frac{1}{16}^{th}$ of an inch. In certain examples, the spacing tolerance may be $\frac{1}{32}^{nd}$ of an inch.

Accordingly, depending on the type and shape of host article 100, the top hole punching plate assembly 402 can be selected and/or adjusted to produce the desired pattern 110 of holes 216 in the host article 100 that will correctly match to the pattern 210 produced in the decorative patch 200. In some examples, different top hole punching plate assemblies 402 can be used to achieve the slightly different hole spacings needed for different host articles 100. In other examples, the top hole punching plate assembly 402 may be configurable such that the positions of the hole punchers 412 may be slightly adjustable to alter the horizontal spacing 112 and/or the vertical spacing 114 as needed.

According to certain examples, the same bottom hole punching plate assembly 404 can be used for punching the holes 216 and 226. For example, the receiving pads 422 can be sized sufficiently large so as to accommodate slightly different horizontal and/or vertical spacings of the hole punchers 412 discussed above. In certain examples, different spacers 424 may be used depending on the article being hole punched. For example, when the holes 226 are punched in the decorative patch 200, the spacer 424 may be substantially flat and have a height substantially equal to a height of the receiving pads 422 above the base plate 420. In other examples, such as when the host article 100 has curvature, as in the case of various types of hats, the spacer 424 may be configured to match or accommodate such curvature. For example, as shown in FIGS. 6A and 6B, the spacer 424 may have a curved top surface that extends above the height of the receiving pads 422. In certain examples, the spacer 424 may be either removably attached to the base plate 420 or simply placed (without attachment) on the base plate 420 during use, such that different spacers may be easily changed and used for hole punching different host articles, without necessarily requiring any other changes to the bottom hole punching plate assembly 404.

To perform a hole punching process 306 or 308, once the top and bottom hole punching plate assemblies 402, 404 have been selected and/or configured, they can be attached to the press tool 400 as discussed above. Alignment may be checked to ensure that, when the top hole punching plate assembly 402 is lowered towards the bottom hole punching plate assembly 404, the hole punchers 412 are aligned with the receiving pads 422. Further, the press tool 400 may be configured to be set to the correct depth (e.g., extension range of the movable portion 406) to punch the holes 216 or 226. If the depth is set too high (i.e., insufficient range of movement of the movable portion 406), the holes 216 or 226 may not be punched all the way through the article. If the depth is set too low, the hole punchers 412 may forcibly impact the receiving pads 422, which may cause damage (especially over time) to the top and/or bottom hole punching plate assemblies 402, 404.

When the hole punching apparatus is correctly prepared and configured, as discussed above, the article to be hole punched (host article 100 or decorative patch 200) may be placed and aligned on the bottom hole punching plate assembly 404 (step 314), and the press tool may be operated to punch the desired hole pattern (step 316). In certain examples, the alignment piece 414 may be used to correctly position the article on the bottom hole punching plate assembly 404.

Referring again to FIG. 5, each of the processes 302 and 304 includes a step 318 of placing the fasteners into the holes that were produced in steps 306 or 308, and the fasteners are then secured in place using a snap setting apparatus (steps 320, 322). In certain examples, the press tool 400 may also be used for snap setting. In certain examples, step 318 may be performed in combination with step 320 or step 322, rather than completely before either step 320 or step 322, as discussed further below.

Figure 10:
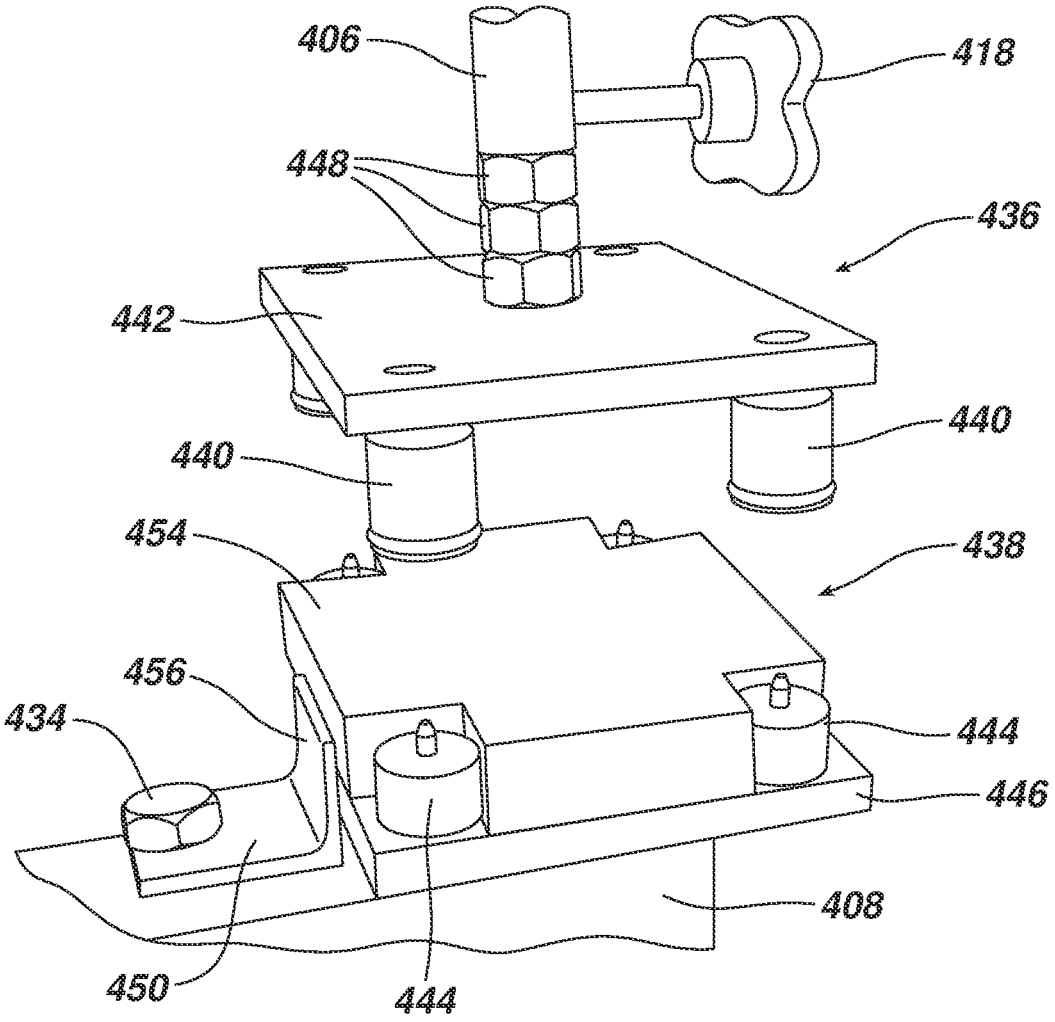
FIG. 10 is an image of one example of a snap setting apparatus including a pair of snap setting plate assemblies attached to a press tool, according to certain embodiments.

According to certain embodiments, all the fasteners 120 for a given host article 100 may be set simultaneously in step 322 using the press tool 400 and a pair of snap setting plate assemblies. FIG. 10 illustrates an example of a pair of snap setting plate assemblies 436, 438 attached to the press tool 400. As discussed above, in certain examples, the host article fasteners 120 each include a stud 122 and a post 124. Accordingly, in such examples, the first snap setting plate assembly 436 includes a plurality of stud setters 440 mounted to a stud plate 442, and the second snap setting stud plate assembly 438 includes a corresponding plurality of post anvils 444 mounted to a post anvil plate 446. The plurality of stud setters 440 and the plurality of post anvils 444 are arranged to match the selected host hole/fastener pattern 110. The stud plate 442 and post anvil plate 446 may be metal plates, for example.

As shown in FIG. 10, according to certain embodiments, the first snap setting plate assembly 436 may be attached to the movable portion 406 of the press tool 400, in a manner similar to that described above with respect to the top hole punching plate assembly 402. For example, the first snap setting stud plate assembly 436 may include a rod (obscured in FIG. 10 by nuts 448) that can be inserted into an opening in the movable portion 406 and secured by tightening the clamp 418. The nuts 448 may serve as spacers to vertically position the first snap setting plate assembly 436 as desired. The plurality of stud setters 440 can be attached to the stud plate 442 using any suitable permanent or non-permanent attachment means. In one example, the stud setters 440 can be screwed into the stud plate 442.

Figure 11:
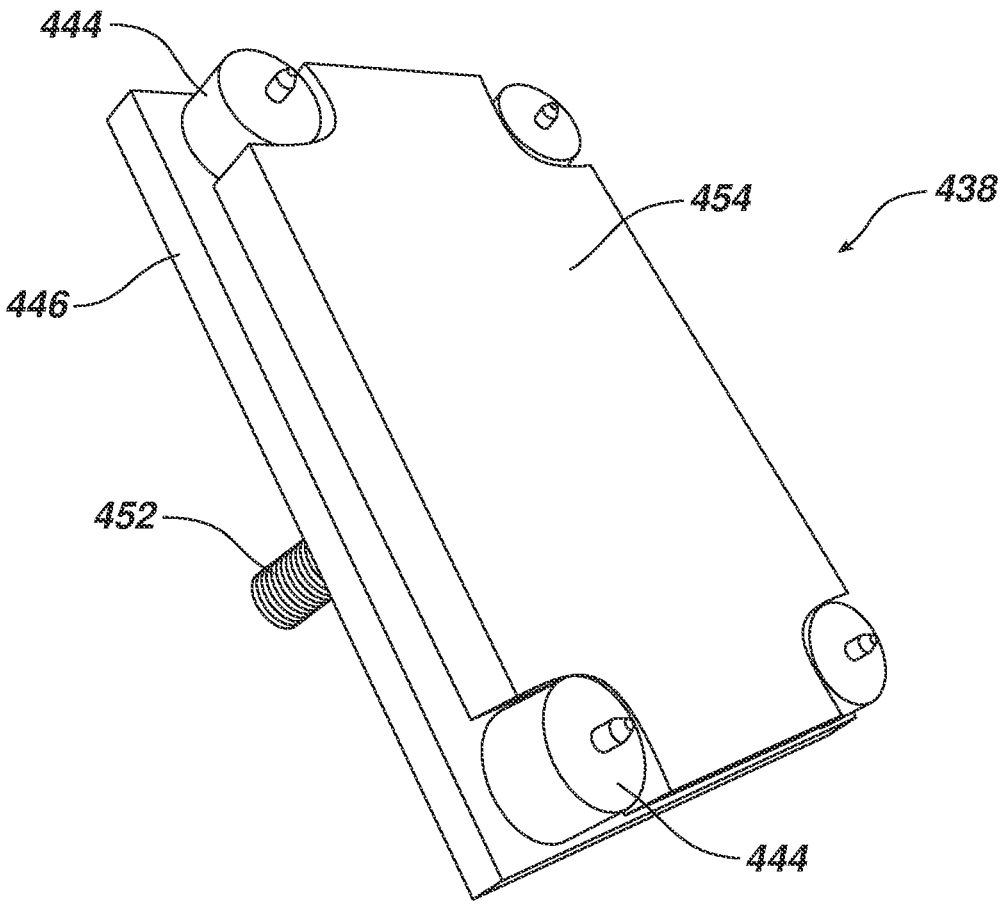
FIG. 11 is a perspective view of one example of a snap setting plate assembly according to certain embodiments.

The second snap setting plate assembly 438 may be attached to the lower arm 408 of the press tool 400 in a manner similar to that described above with reference to the bottom hole punching plate assembly 404. For example, the post anvil plate 446 may include a flange 450 having a hole therein (similar to the flange 426 with hole 432 of the base plate 420) to allow the post anvil plate 446 to be attached to the arm 408 of the press tool 400 using the fastener 434. As shown in FIG. 11, the second snap setting plate assembly 438 may also include a pin 452 extending from a lower side of the post anvil plate 446 that can be inserted into a hole in the arm 408 of the press tool 400, as discussed above with reference to the bottom hole punching plate assembly 404. The second snap setting plate assembly 438 further includes a snap setting spacer 454 that is arranged around the plurality of post anvils 444 on the post anvil plate 446, as shown in FIGS. 10 and 11. In certain examples, the flange 450 or post anvil plate 446 may include an upwardly extending barrier portion 456 that acts as a positioning barrier for the snap setting spacer 454. For example, the snap setting spacer 454 may be placed on the post anvil plate 446 between the plurality of post anvils 444 and pushed against the barrier portion 456 to ensure proper placement on the post anvil plate 446. The snap setting spacer 454 may be secured to the post anvil plate 446 or may simply rest on the post anvil plate 446. The snap setting spacer 454 may be a rigid material (e.g., polycarbonate, a rigid plastic, a rigid foam, or other hard material) or may be a softer/more flexible material, such as a thick foam (e.g., a latex or "memory foam" type material), a packaged gel-like material, cardboard, and the like.

Figure 12:
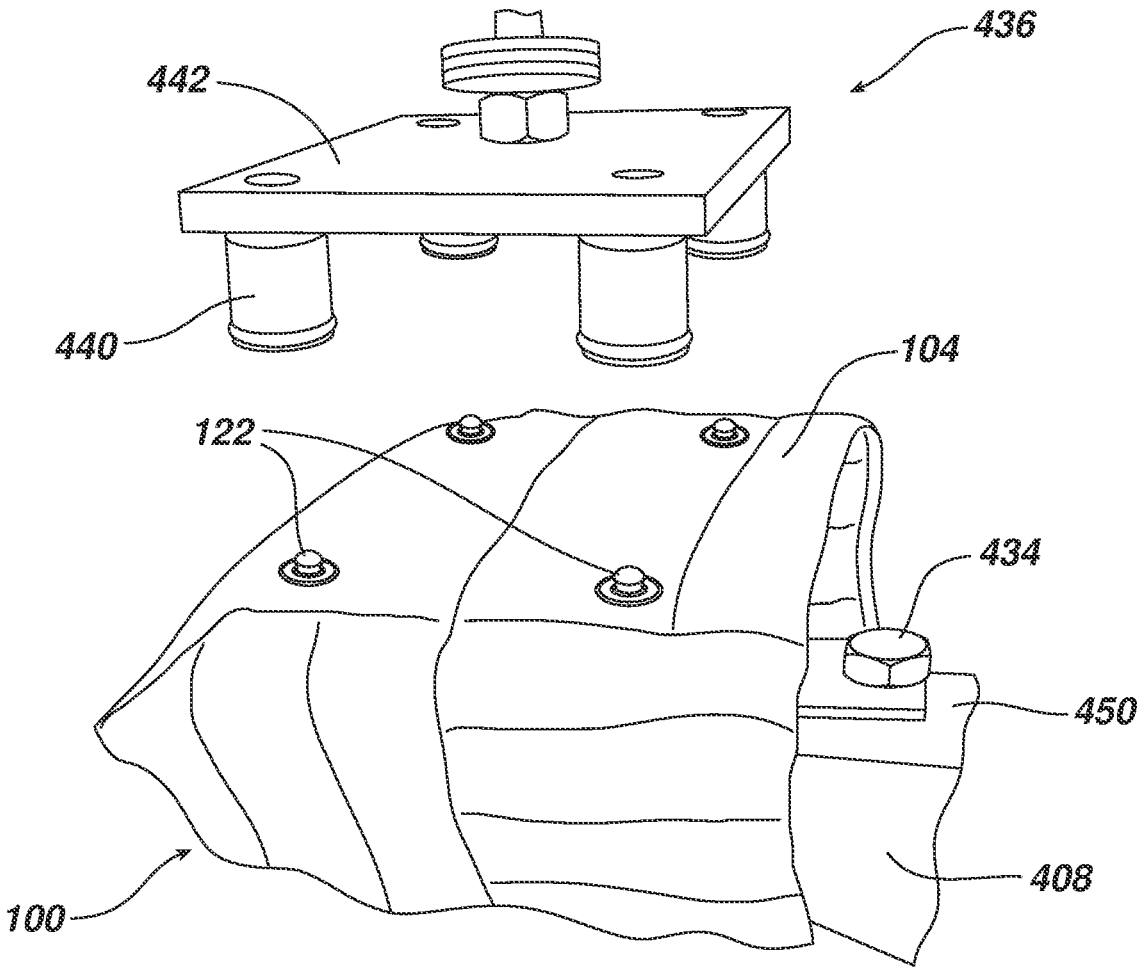
FIG. 12 is an image showing an example of a host article positioned on the snap setting apparatus according to certain embodiments.

To set the snaps in a host article 100, the host fasteners 120 may be inserted into the prepared holes 216 in the host article 100 (step 318). The post 124 may be inserted from the reverse side of the host article 100 through the hole 216, and the stud may be placed onto the post on the front side (where the decorative patch 200 will be attached) of the host article 100. The press tool may be checked for alignment and correct settings, for example, by lowering the movable portion 406 to check that the depth is set correctly (e.g., in the extended/lowered position, the stud setters 440 contact the post anvils 444) and that, in the lowered position, each stud setter 440 is centered on each post anvil 444. Alignment may be adjusted by adjusting the attachment of the first and second snap setting plate assemblies 436, 438 to the press tool 400 and/or my adjusting the positioning of the stud setters 440 and/or post anvils 444 on the stud plate 442 or post anvil plate 446, respectively. The host article 100 may be placed on the second snap setting plate assembly 438, with each post 124 placed on a corresponding post anvil 444. FIG. 12 shows an example of a host article 100 (in this case, a stocking cap) placed over the second snap setting plate assembly 438 on the lower arm 408 of the press tool 400, with the studs 122 visible on the front side 104 of the host article 100. The press tool 400 may then be operated to lower the first snap setting plate assembly 436 with sufficient force/pressure that the stud setters 440 set the studs 122 to the posts 124, thus securing the host fasteners 120 to the host article 100 (step 322). The snaps 120 should be set tight enough that one cannot easily separate the stud 122 and the material of the host article 100 (e.g., by sliding a fingernail or thin object between the stud 122 and the material of the host article 100). If the snap is not set tightly enough, the press tool may be adjusted to apply more pressure during the setting operation, and the setting operation may be repeated to properly set the snap fasteners 120.

Figure 13A:
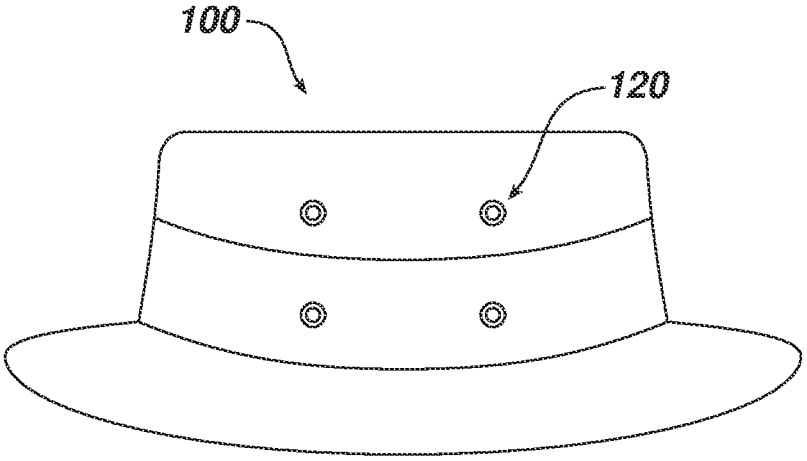
FIG. 13A is a diagram of one example of a host article prepared with a pattern of snap fasteners according to certain embodiments.
Figure 13B:
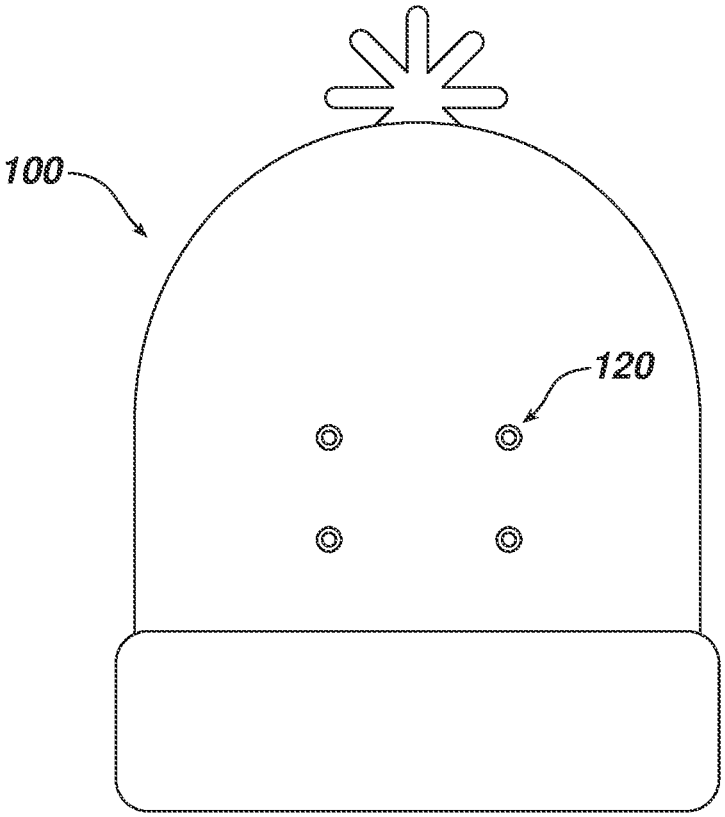
FIG. 13B is a diagram of another example of a host article prepared with a pattern of snap fasteners according to certain embodiments.

FIGS. 13A and 13B illustrated examples of host articles 100 prepared with the host pattern 110 of host fasteners 120 after step 322 of process 304. In the example of FIG. 13A, the host article 100 is a flat-brimmed hat. In the example of FIG. 13B, the host article 100 is a stocking cap. Similarly, in the example of FIG. 2 discussed above, the host article 100 is a bag. Those skilled in the art will appreciate that the numerous other types and styles of host articles 100 may be prepared using the above-discussed processes and apparatus.

Similarly, the press tool 400 and a pair of snap setting plate assemblies may be used to set the snap fasteners 220 in the decorative patches 200. As discussed above, in certain examples, the patch fasteners 220 each include a cap 222 and socket 224 pair, with the socket being configured to receive the stud 122 of the corresponding host fastener 120. Accordingly, the snap setting plate assemblies used for setting the snap fasteners in the decorative patches 200 may include a first patch snap setting plate assembly with a plurality of cap anvils, and a second patch snap setting plate assembly with a plurality of socket setters.

Figure 14:
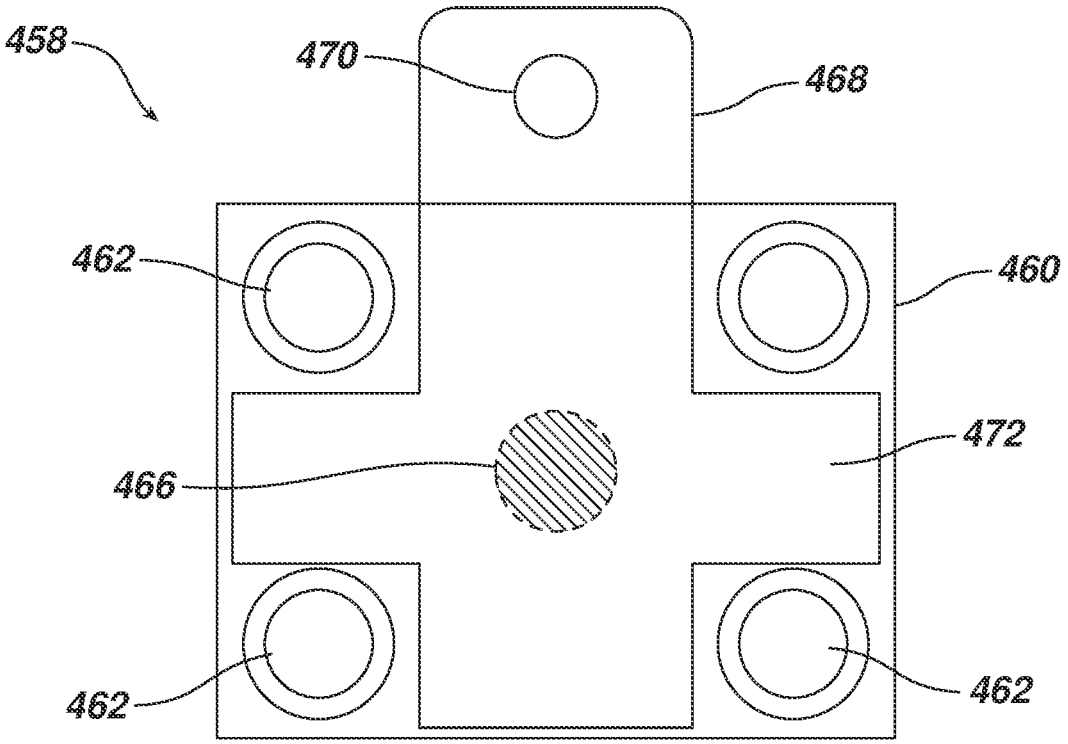
FIG. 14 is a diagram showing a top view of one example of a first patch snap setting plate assembly according to certain embodiments.
Figure 15:
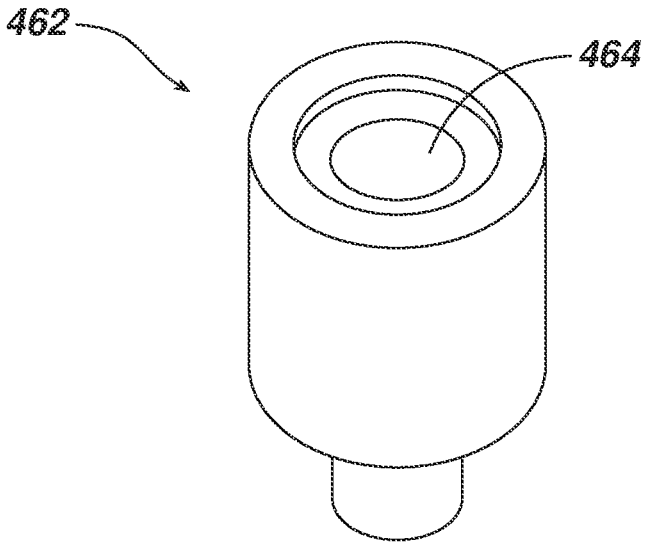
FIG. 15 is an image of one example of a cap anvil that may be used with the first patch snap setting plate assembly of FIG. 14, according to certain embodiments.

FIG. 14 is a diagram of one example of a first patch snap setting plate assembly 458 that can be attached to the lower arm 408 of the press tool 400, in a manner similar to that discussed above. The first patch snap setting plate assembly 458 includes a cap anvil plate 460 with a plurality of cap anvils 462 arranged corresponding to the patch fastener pattern 210. Each cap anvil 462 has a recess 464 sized to receive the cap 222. FIG. 15 illustrates an example of a cap anvil 462. The first patch snap setting plate assembly 458 may include a pin 466 and a flange 468 with a hole 470 for attaching the first patch snap setting plate assembly 458 to the lower arm 408 of the press tool 400 as discussed above. Once attached to the press tool 400, the first patch snap setting plate assembly 458 sits with the cap anvils 462 facing upwards towards the movable portion 406 of the press tool 400. The first patch snap setting plate assembly 458 may further include a patch spacer 472 positioned on the cap anvil plate 460 around the plurality of cap anvils 462. In one example, the patch spacer 472 has a height matched to the plurality of cap anvils 462 such that when decorative patch 200 rests on the patch spacer 472, it is positioned at the correct height for the caps 222 to rest in the cap anvils 462. The patch spacer 472 may be made of a rigid or softer material, such as any of the materials discussed above with respect to spacers 424 and 454.

Figure 16:
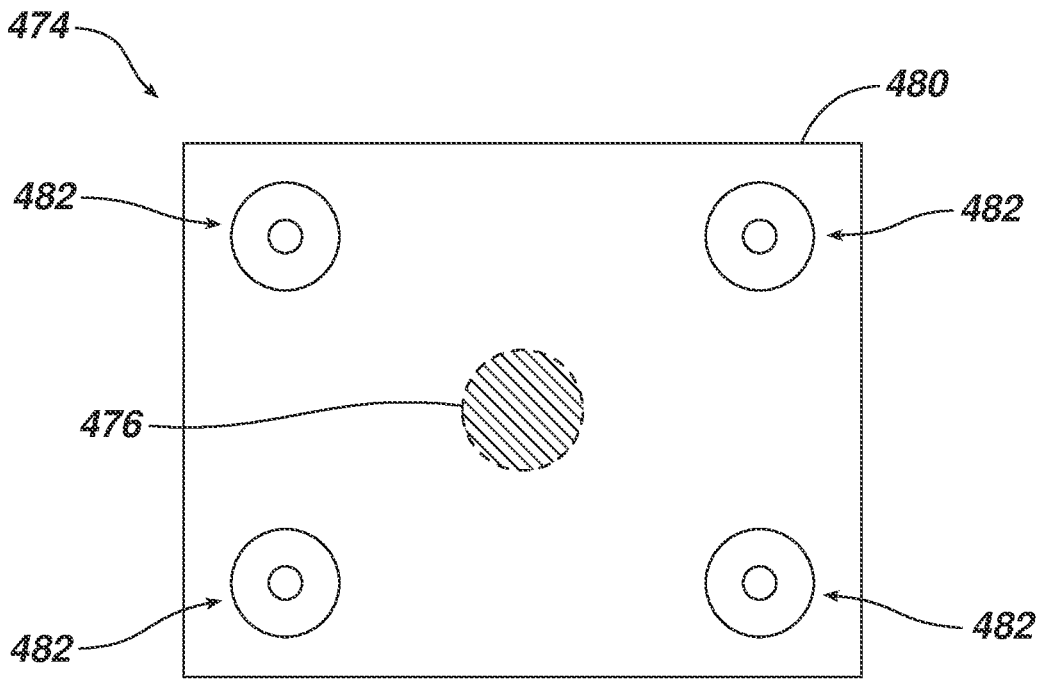
FIG. 16 is a diagram showing a top view of one example of a second patch snap setting plate assembly according to certain embodiments.
Figure 17:
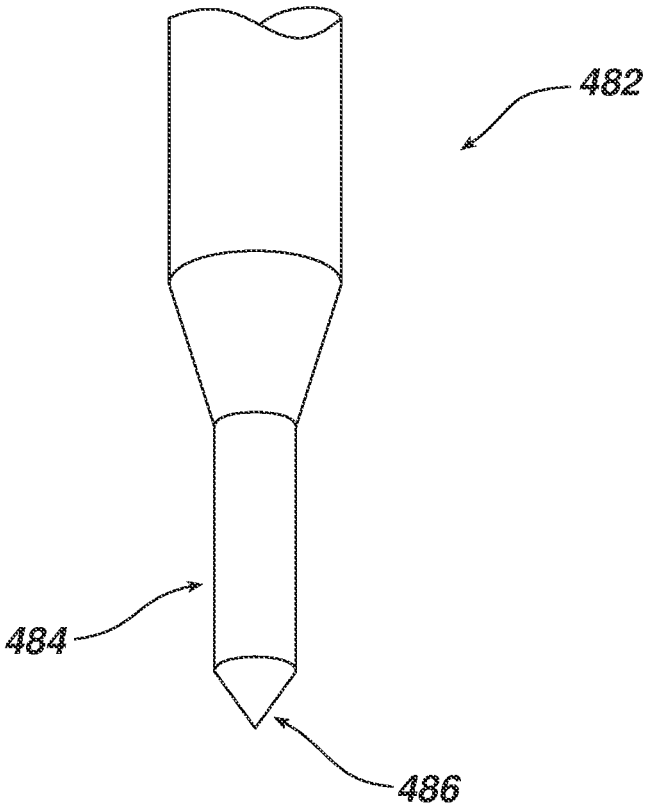
FIG. 17 is an image of one example of a socket setter that may be used with the second patch snap setting plate assembly of FIG. 16, according to certain embodiments.

FIG. 16 is a diagram of one example of a second patch snap setting plate assembly 474 that can be attached to the movable portion 406 of the press tool 400, in a manner similar to that discussed above. For example, the second patch snap setting plate assembly 474 may include a pin 476 on its reverse side configured to be inserted into an opening in the movable portion 406 of the press tool 400, as discussed above. The second patch snap setting plate assembly 474 includes a socket plate 480 with a plurality of socket setters 482 arranged corresponding to the patch fastener pattern 210. FIG. 17 illustrates an example of a socket setter 482. The socket setter 482 includes a shaft 484 with a rounded tip 486 sized to fit into the opening 228 of the socket 224 (see FIG. 4B). Once attached to the press tool 400, the second patch snap setting plate assembly 474 is held in the movable portion 406 of the press tool 400 with the socket setters 482 facing downwards towards the cap anvils 462 of the first patch snap setting plate assembly 458.

To set the snap fasteners 220 in the decorative patch 200, the first and second patch snap setting plate assemblies 458, 474 may be attached to the press tool as discussed above. Alignment and pressure settings of the press tool 400 may be checked and adjusted if necessary. For example, the movable portion 406 may be lowered to check that, when in the extended/lowered position, the shafts 484 of the socket setters 482 are centered in the recesses 464 of the cap anvils 462 and contact the cap anvils 462. Alignment may be adjusted by adjusting the attachment of the first and second patch snap setting plate assemblies 458, 474 to the press tool 400 and/or my adjusting the positioning of the socket setters 482 and/or cap anvils 462 on the socket plate 480 or cap anvil plate 460, respectively.

The caps 222 may be placed in each of the holes 226 on the front side (that having the decoration 230) of the decorative patch 200, and pressed in such that the extensions 240 (see FIG. 4A) of the posts extend slightly through the holes 226 to the reverse side of the decorative patch 200 (step 318). The decorative patch 200 may be placed face-down onto the first patch snap setting plate assembly 458, such that the caps 222 rest in the recesses 464 of the cap anvils 462. The sockets 224 may be placed in/over the holes 226 on the reverse side of the decorative patch 200 (side facing up towards the second patch snap setting plate assembly 474) and gently pressed onto the extensions 240 of the caps 222 (step 318). The press tool may then be operated to lower the second patch snap setting plate assembly 474 with sufficient force/pressure that the socket setters 482 set the sockets 224 to the caps 222, thus securing the patch fasteners 220 to the decorative patch 200 (step 320). The finished decorative patch 200 thus appears as shown in FIGS. 1, 3A and 3B, with the caps 222 on the front (decorative) side of the decorative patch 200 and the sockets on the reverse side such that the decorative patch can be snapped onto a correspondingly prepared host article 100.

Thus, aspects and embodiments provide processes and apparatus that can be used to produce lines of host articles and decorative patches that can be interchangeably used and reused with one another. Using snap fasteners as discussed above overcomes the problem of limited use associated with conventional methods of decorating or embellishing clothing or accessories that result in permanent (or at least semi-permanent) attachment of the decoration to the clothing or accessory. Further, the methods and apparatus discussed above allow for patterns of snap fasteners to be attached to the decorative patches and host articles simultaneously, thus saving time compared to having to individually attach each snap fastener, while also reducing inconsistencies or alignment errors in the fastener locations and producing higher yield and higher quality end products.

Having described above several aspects of at least one embodiment, it is to be appreciated various alterations, modifications, and improvements will readily occur to those skilled in the art. Such alterations, modifications, and improvements are intended to be part of this disclosure and are intended to be within the scope of the invention. It is to be appreciated that embodiments of the methods and apparatuses discussed herein are not limited in application to the details of construction and the arrangement of components set forth in the foregoing description or illustrated in the accompanying drawings. The methods and apparatuses are capable of implementation in other embodiments and of being practiced or of being carried out in various ways. Examples of specific implementations are provided herein for illustrative purposes only and are not intended to be limiting. Also, the phraseology and terminology used herein is for the purpose of description and should not be regarded as limiting. The use herein of "including," "comprising," "having," "containing," "involving," and variations thereof is meant to encompass the items listed thereafter and equivalents thereof as well as additional items. References to "or" may be construed as inclusive so that any terms described using "or" may indicate any of a single, more than one, and all of the described terms. Accordingly, the foregoing description and drawings are by way of example only, and the scope of the invention should be determined from proper construction of the appended claims, and their equivalents.

What is claimed is:

1. A method of customizing a host article with a removably attachable decorative patch, the method comprising:

simultaneously punching a first plurality of holes into a front surface of the host article, the first plurality of holes being arranged in a first regular pattern;

positioning a plurality of host snap fasteners in the first plurality of holes, each host snap fastener corresponding to a respective one of the first plurality of holes;

simultaneously setting the plurality of host snap fasteners to secure the plurality of host snap fasteners to the host article;

simultaneously punching a second plurality of holes into the decorative patch, the second plurality of holes being of a same number as the first plurality of holes and being arranged in a second regular pattern corresponding to the first regular pattern; and setting a plurality of patch snap fasteners in the second plurality of holes to secure the plurality of patch snap fasteners to the decorative patch, the plurality of patch snap fasteners being configured to mate with the plurality of host snap fasteners removably attach the decorative patch to the host article.

2. The method of claim 1 wherein setting the plurality of patch snap fasteners includes: positioning the plurality of patch snap fasteners in the second plurality of holes, each patch snap fastener corresponding to a respective one of the second plurality of holes; and simultaneously setting the plurality of host snap fasteners to secure the plurality of patch snap fasteners to the decorative patch.

3. The method of claim 1 wherein the decorative patch has a rectangular shape having four corners, wherein the plurality of patch snap fasteners includes four patch snap fasteners, and wherein simultaneously punching the second plurality of holes into the decorative patch includes simultaneously punching four holes at the four corners of the decorative patch, such that the second regular pattern is a first rectangular pattern having a first horizontal hole spacing and a first vertical hole spacing.

4. The method of claim 3 wherein simultaneously punching the first plurality of holes into the host article includes simultaneously punching four holes, the first regular pattern being a second rectangular pattern having a second horizontal hole spacing and a second vertical hole spacing.

5. The method of claim 4 wherein the first and second horizontal hole spacings are the same.

6. The method of claim 4 wherein the first horizontal hole spacing is different from the second horizontal spacing by an amount that is determined by a curvature of the front surface of the host article.

7. The method of claim 4 further comprising:

simultaneously punching a third plurality of holes into a front surface of another host article, the third plurality of holes including four holes arranged in a third regular pattern;

positioning a second plurality of host snap fasteners in the third plurality of holes, each host snap fastener corresponding to a respective one of the third plurality of holes; and simultaneously setting the second plurality of host snap fasteners to secure the second plurality of host snap fasteners to the additional host article;

wherein the third regular pattern is a third rectangular pattern having a third horizontal hole spacing and a third vertical hole spacing; and wherein the first and third horizontal hole spacings are different and the first and third vertical hole spacings are different.

8. The method of claim 1 wherein simultaneously punching the first plurality of holes into the host article is performed using first and second hole punching plate assemblies attached to a press tool.

9. The method of claim 8 wherein simultaneously setting the plurality of host snap fasteners is performed using first and second snap setting plate assemblies attached to the press tool.

* * * * *